US007296706B2

(12) United States Patent
Raterman et al.

(10) Patent No.: US 7,296,706 B2
(45) Date of Patent: Nov. 20, 2007

(54) METHOD AND SYSTEM FOR SUPPORTING AND/OR ALIGNING COMPONENTS OF A LIQUID DISPENSING SYSTEM

(75) Inventors: John M. Raterman, Atlanta, GA (US); Christopher R. Chastine, Hoschton, GA (US); Alain Chouinard, Laval (CA); Greg A. Craig, Dallas, GA (US); David Pullagura, Norcross, GA (US); Matthew R. Tinaglia, Suwanee, GA (US)

(73) Assignee: Nordson Corporation, Westlake, OH (US)

( * ) Notice: Subject to any disclaimer, the term of this patent is extended or adjusted under 35 U.S.C. 154(b) by 399 days.

(21) Appl. No.: 10/976,953

(22) Filed: Oct. 29, 2004

(65) Prior Publication Data

US 2005/0184086 A1 Aug. 25, 2005

Related U.S. Application Data

(60) Provisional application No. 60/547,378, filed on Feb. 24, 2004.

(51) Int. Cl.
*B67D 5/62* (2006.01)

(52) U.S. Cl. ..... 222/1; 222/146.5; 222/570

(58) Field of Classification Search ..... 222/146.5, 222/567, 571, 1; 137/884
See application file for complete search history.

(56) References Cited

U.S. PATENT DOCUMENTS

| | | | | |
|---|---|---|---|---|
| 3,115,282 A | | 12/1963 | McKenzie | |
| 3,612,069 A | | 10/1971 | Waters et al. | |
| 3,851,801 A | * | 12/1974 | Roth | 222/146.5 |
| 4,549,866 A | | 10/1985 | Granville | |
| 4,600,128 A | | 7/1986 | Rohrer | |
| 4,653,199 A | | 3/1987 | McLeod et al. | |
| 4,688,609 A | | 8/1987 | Diaz | |
| 4,874,014 A | | 10/1989 | Grant et al. | |
| 5,000,112 A | | 3/1991 | Rothen et al. | |
| 5,063,790 A | * | 11/1991 | Freeman et al. | 73/864.14 |
| 5,375,738 A | * | 12/1994 | Walsh et al. | 222/1 |
| 5,478,224 A | | 12/1995 | McGuffey | |
| D401,600 S | | 11/1998 | Byerly et al. | |

(Continued)

OTHER PUBLICATIONS

Keystone Industries, Adhesive Applicator Systems & Parts, Catalog Year 2001, 5 pgs.

(Continued)

*Primary Examiner*—Joseph A. Kaufman
(74) *Attorney, Agent, or Firm*—Wood, Herron & Evans, LLP

(57) ABSTRACT

In a liquid dispensing system having a dispensing module and a gun manifold, the gun manifold includes a shelf portion that extends outwardly from its front face and the dispensing module includes a correspondingly shaped aperture configured to engage the shelf portion so that the dispensing module rests, or hangs, on the gun manifold without being held into place. From this position, the module can be easily and readily attached to the manifold. The shelf and aperture have complementary shapes and can be keyed so as to require the mating of the manifold and module in only one orientation. Additionally, an adaptor can be provided between the module and manifold so that smooth face manifolds and modules can still be coupled to corresponding manifolds and modules having shelves or apertures.

39 Claims, 12 Drawing Sheets

U.S. PATENT DOCUMENTS

| | | | | |
|---|---|---|---|---|
| 5,915,625 | A | 6/1999 | Focke et al. | 239/112 |
| 6,056,155 | A | 5/2000 | Byerly et al. | 222/1 |
| 6,089,413 | A | 7/2000 | Riney et al. | |
| D429,263 | S | 8/2000 | Auber et al. | |
| 6,105,832 | A | 8/2000 | Beck | 222/571 |
| 6,123,302 | A | 9/2000 | Taylor | 248/231.61 |
| 6,260,583 | B1 | 7/2001 | Flatt et al. | |
| 6,286,721 | B1 * | 9/2001 | Pellegrini | 222/129.1 |
| 6,354,463 | B1 | 3/2002 | Pahl | 222/1 |
| 6,358,322 | B1 | 3/2002 | Pahl | 118/680 |
| D456,427 | S | 4/2002 | Gressett, Jr. et al. | D15/144 |
| 6,406,625 | B1 | 6/2002 | Brock et al. | |
| D460,092 | S | 7/2002 | Gressett, Jr. et al. | D15/144.1 |
| 6,435,425 | B1 | 8/2002 | Saidman | |
| 6,572,033 | B1 | 6/2003 | Pullagura et al. | |
| 6,601,741 | B2 | 8/2003 | McGuffey | |
| 6,669,057 | B2 * | 12/2003 | Saidman et al. | 222/146.5 |
| 6,931,205 | B2 | 8/2005 | Atkins | |
| 7,082,262 | B2 | 7/2006 | Clark et al. | |
| 2003/0080155 | A1 | 5/2003 | Jeter | |
| 2003/0192292 | A1 | 10/2003 | Seedorf | |
| 2003/0200921 | A1 | 10/2003 | Crane et al. | |
| 2004/0033069 | A1 | 2/2004 | Atkins | |
| 2005/0235909 | A1 | 10/2005 | Jones | |
| 2005/0235911 | A1 | 10/2005 | Chambers et al. | |
| 2005/0236316 | A1 | 10/2005 | Gould et al. | |

OTHER PUBLICATIONS

Watlow Electric Manufacturing Companys, Revolutionizing the Heater Industry, Brochure, 7 pgs. 2001.

Nordson Corporation, *LV 227 Adhesive Dispensing Pneumatic Gun*, Brochure, Apr. 2003 (2 pgs.).

* cited by examiner

METHOD AND SYSTEM FOR SUPPORTING AND/OR ALIGNING COMPONENTS OF A LIQUID DISPENSING SYSTEM

This application claims the benefit of U.S. Provisional Application No. 60/547,378 filed on Feb. 24, 2004, the disclosure of which is hereby incorporated by reference herein.

FIELD OF THE INVENTION

The present invention generally relates to liquid dispensing systems having separate components that are coupled together and, more particularly, to the manners in which such components are fastened together.

BACKGROUND OF THE INVENTION

Viscous liquids or fluids are applied by dispensers onto a surface of a substrate in a variety of dispensing applications employed in the manufacture of products and product packaging. These viscous liquids include thermoplastic materials such as hot melt adhesives. Liquid dispensers utilize pneumatically or electrically actuated valve assemblies for metering a precise quantity of the viscous liquid and discharging the metered amount through a small-diameter dispensing orifice. Many thermoplastic materials exist in a solid form at room or ambient temperature and must be heated to create a flowable viscous liquid. Other hot melt adhesive materials are supplied as liquids at room temperature. A solid form of material is placed in a holding tank having heated walls and is melted by heating the solid material above its melting point. The viscous liquid is pumped in a molten state under pressure from the holding tank through a supply conduit to a manifold block. The manifold block has liquid passageways connected in fluid communication with the dispensing orifice of one or more liquid dispensers.

A dispensing module that includes the dispensing orifice is usually connected to the manifold block, sometimes referred to as a gun body or gun manifold, by way of screws or bolts that extend through the module and into threaded holes in the face of the gun manifold. In order for the liquid dispensing system to operate properly, this connection of the manifold with the module must be accomplished so that fluid or liquid ports on each of the manifold and module are properly aligned so as to provide leak-proof fluid communication between the two subassemblies or components. In the case of a pneumatically operated module and/or one which provides air-assisted liquid dispensing, cross-connection of an air port with an adhesive port must be avoided. Connecting the two subassemblies entails placing the module in its proper position and then, while holding the module steady, threading the connecting bolts through the module into the manifold. Misalignment may cause the adhesive to leak from the gun onto a conveying system and/or substrate as well as to leak into the air section of the module.

Oftentimes, operational or maintenance personnel will need to remove the module from the manifold for such purposes as cleaning or attaching a different module. Thus, a need exists for an interface between a dispensing module and a gun manifold that simplifies attachment of the module, prevents misalignment of the two subassemblies and their respective fluid ports during attachment, and prevents misconnecting the two subassemblies.

SUMMARY OF THE INVENTION

The invention is generally directed to an apparatus for dispensing liquid thermoplastic material, such as hot melt adhesive, including at least a first component which is configured for easier attachment and removal with respect to a second component of a dispensing system. More particularly, the first component includes a first side and at least one passageway for receiving the liquid thermoplastic material. The passageway includes an opening on the first side and the first component further includes a first interactive surface on the first side and configured as one of a recessed portion extending only partially into the first component or a projecting portion configured to extend only partially into the second component. The first interactive surface is adapted to cooperate with the second interactive surface on the second component and thereby either at least partially supports the first component on the second component or at least partially supports the second component on the first component, depending on which component receives the other component.

The various components which may incorporate the interactive surfaces of the present invention include, for example, dispensing modules, gun manifolds, adaptors, or other liquid dispensing components of systems designed to dispense liquid thermoplastic material, such as hot melt adhesive.

In the preferred embodiment, the first and second interactive surfaces cooperate to self-support one of the first and second components on the other of the first and second components. The first and second interactive surfaces have asymmetric shapes which cooperate for such self-support in one orientation but not when in an opposite orientation. The first and second components may include respective first and second air ports which align when the first and second interactive surfaces cooperate. The interactive surfaces may include asymmetrically curved surfaces which may further comprise curvilinear surfaces having different radii of curvature. The curvilinear surfaces may define either a recessed portion or a projecting portion therebetween. The recessed portion and the projecting portion may be generally bow-tie shaped, or may have various other shapes such as rectangular shapes, dovetail shapes or other shapes including angled surface portions or combinations of straight surfaces with curved surfaces.

Generally, a method for attaching the first component to the second component includes at least partially supporting one of the first and second components on the other of the first and second components by engaging the recessed portion of the first component with the projecting portion of the second component. First and second liquid ports, located on the same faces as the recessed and projecting portions, are aligned in fluid communication with each other. A separate fastener is then used to fasten the first component to the second component.

It will be appreciated that the foregoing aspects of the invention are applicable to various types of dispensing systems, which may involve pneumatic or electric actuation. These various aspects are also applicable to various components of such systems which would benefit from the features described herein. These and other features, objects and advantages of the invention will become more readily apparent to those of ordinary skill in the art upon review of the following detailed description, taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to illustrate various embodiments of the invention.

DETAILED DESCRIPTION

Various terms of spatial reference and orientation are used throughout this specification, such as "vertical", "upward", "downward" and the like. Such terms are not to be construed in a limiting manner, but are merely used for the sake of clarity in describing the examples and embodiments of the invention described herein. For example, terms such as "vertically supported" mean that one component is capable of being supported in a vertical manner relative to another component, and not that it necessarily has to be supported in that manner in a given application.

Figure 1:
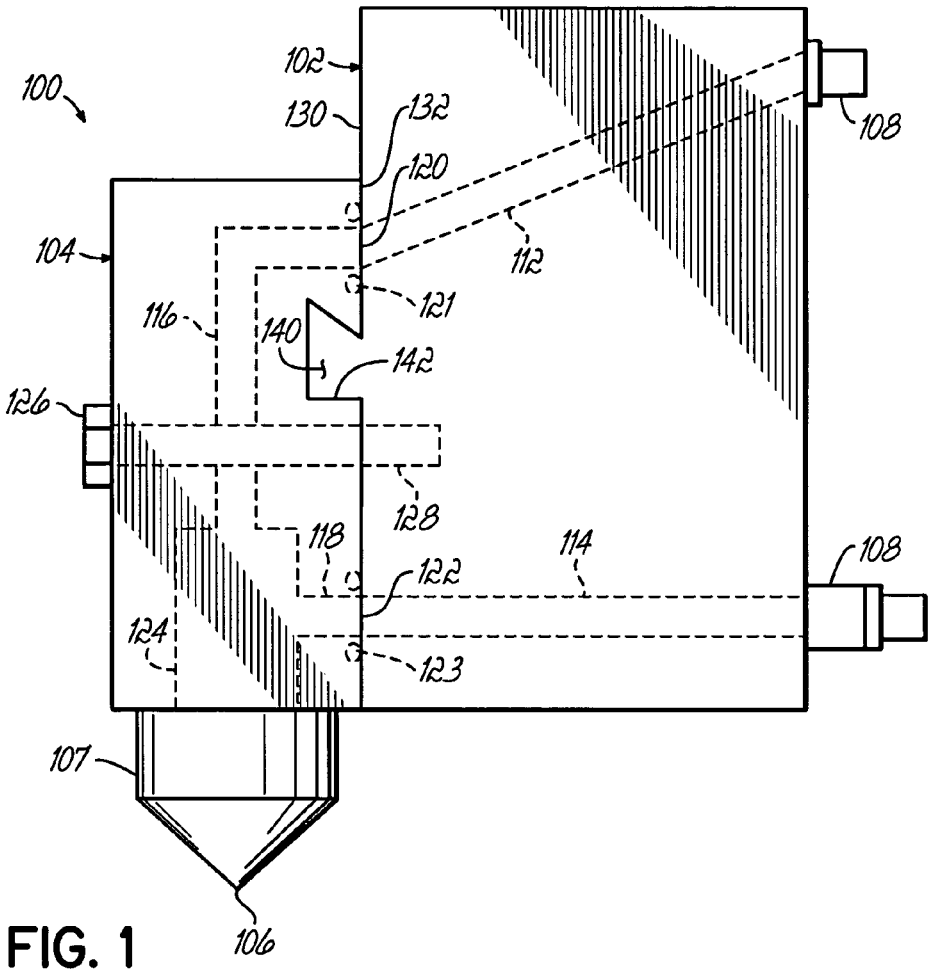
FIG. 1 illustrates a liquid dispensing system according to an embodiment of the present invention.
Figure 4:
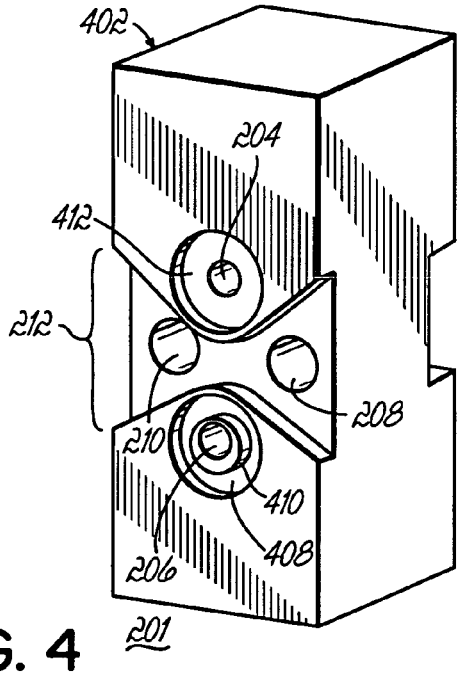
FIGS. 4-11 illustrate exemplary embodiments of gun modules in accordance with the principles of the present invention.

FIG. 1 illustrates a schematic view of an assembled liquid dispensing system, or gun, 100. This system 100 is typically connected to a source of melted adhesive (not shown) and a pressurized air source (not shown). In packaging applications, such a gun 100 is mounted and a substrate moves in relation to the gun; in other applications, the gun 100 is mounted on a movable platform and controlled by a robot or other automated positioning system. In particular, a gun manifold 102 is connected with a dispensing module 104 that includes a dispensing orifice 106 to deliver adhesive or other liquid in a controlled manner. The dispensing orifice 106 may be located on a nozzle 107 carried by the module 104. The manifold 102 may include a connector 108 that connects with a pressurized air source. Typical hot melt pneumatic adhesive guns operate in a range of between 40 to 70 psi. The manifold 102 also includes a connector 110 that connects with a source of pressurized liquid such as hot melt adhesive. Two passageways may exist within the manifold 102 to communicate liquid from the manifold 102 to the dispensing module 104. The first passageway 112 provides the pressurized air to a corresponding passageway 116 in the module 104. Similarly, the passageway 114 provides the liquid to a corresponding passageway 118 in the module 104. In addition to these passageways 116 and 118, the gun 100 may include a number of other passageways that are not shown. For example, electrical connections may be provided within the module 104 and the manifold 102; also, other exhaust and intake ports may be present to provide such features as "swirl-air" that are used to control the dispensing pattern of the module 104. Thus, a skilled artisan would recognize that the gun 100 may include a number of internal features and passageways such as those found in dispensing pneumatic guns distributed by the present Assignee under such product models as H100, H200, H400, CF200 and H20, for example.

An interface 120 exists where the passageways 112 and 116 meet and another interface 122 exists where the passageways 114 and 118 meet. Each of these interfaces 120 and 122 typically include two matching openings (one on the manifold 102 and the other on the module 104) that mate together to permit fluid communication between the respective passageways. An O-ring 121, 123 or other gasket-like element is often included at the interfaces 120, 122 to help provide a seal.

The module 104 further provides a dispensing chamber 124 that receives the air and the liquid, respectively, from the passageways 116 and 118. From the dispensing chamber 124, the liquid, such as hot melt adhesive, is controllably released through the dispensing orifice 106 typically by air actuation.

The manifold 102 and the module 104 are held together in place using the bolt 126. Typically two bolts are used, although only one is visible in the side view of FIG. 1. Through the passageway 128, the bolt 126 passes through the module 104 and engages threads at the end of the passageway 128 within the manifold 102. In this configuration, a face 132 of the module 104 is put in contact with a corresponding face 130 of the manifold 102. For purposes of orientation, the face 130 is referred to as the front face of the manifold 102 and the face 132 is referred to as the rear face of the module 104.

The manifold 102 additionally includes a projecting portion 140 that extends outwardly from its face 130. The module 104 includes a complementary shaped recessed portion, or channel, 142 on its face 132 that cooperates with the shape of the projecting portion 140. Together, these two features permit the module 104 to be retained by the manifold or to hang or rest from the manifold 102 even without the bolt 126 being present. The module 104, therefore, is supported in the vertical direction by the manifold 102. The recessed portion 142 and the projecting portion 140 are advantageously shaped so that the module 104 is self-supported by the manifold 102 in the vertical direction, or in other words, the module 104 hangs from the manifold 102 without additional support. With the module 104 and the manifold 102 so aligned, the module 104 does not need to be held in place by an operator when threading the bolt 126 through the passageway 128. Bolts 126 extend through holes in the components (such as manifold 102 and module 104)

that may or may not open onto the recessed portion or projecting portion (such as recessed portion 142 or projecting portion 140).

The recessed portion 142 and projection portion 140 may alternatively be configured so as to provide substantial vertical support but still require slight steadying of the module 104 by an operator. Thus, while the module 104 may not freely hang, it is supported enough so that it does not require the operator to hold the module in a proper position while trying to attach the module 104 to the manifold 102. Instead, the projecting portion 140 and the recessed portion act to align the module 104 and manifold 102 so that with one hand the operator may steady the module 104 while, with the other hand, easily attach bolts or other retaining devices. Accordingly, the embodiments of the present invention described herein contemplate modules and manifolds that cooperate to support a module in the vertical direction and, advantageously, cooperate to self-support the module in the vertical direction.

Regardless of whether the module 104 freely hangs or requires some additional operator steadying, through the interaction of the projecting portion 140 and the recessed portion 142, the interface 120 between the air passageways 116 and 112 is properly aligned and the interface 122 between the liquid passageways 114 and 118 is aligned as well. As described in more detail herein with additional embodiments of the present invention, the projection portion 140 and recessed portion 142, in the event of a seal failure or other leak, may act as a dam to prevent adhesive from reaching the air passageway 116 of the module 104 and also may include a channel or similar area to permit adhesive to be diverted from the module 104.

The projecting portion 140 and the recessed portion 142 of FIG. 1 are exemplary in nature and many alternative configurations are possible. The present invention contemplates a variety of interactive, complementary surfaces and shapes that permit the module 104 to be temporarily retained by the manifold 102. In general, the front face 130 of the manifold 102 will include one or more interactive surfaces and the rear face 132 of the module 104 will include complimentary interactive surfaces. When the front face 130 and the rear face 132 are positioned together, the interactive surfaces will communicate with one another and cooperate so as to permit the module 104 to be self-supporting in the vertical direction in relationship to the manifold 102.

Figure 2A:
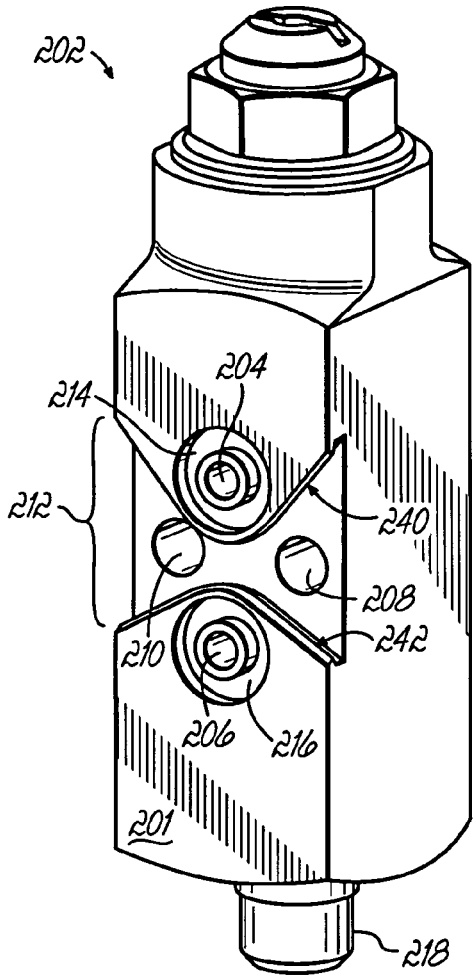
FIGS. 2A-2C illustrate an exemplary dispensing module according to an embodiment of the present invention.
Figure 2B:
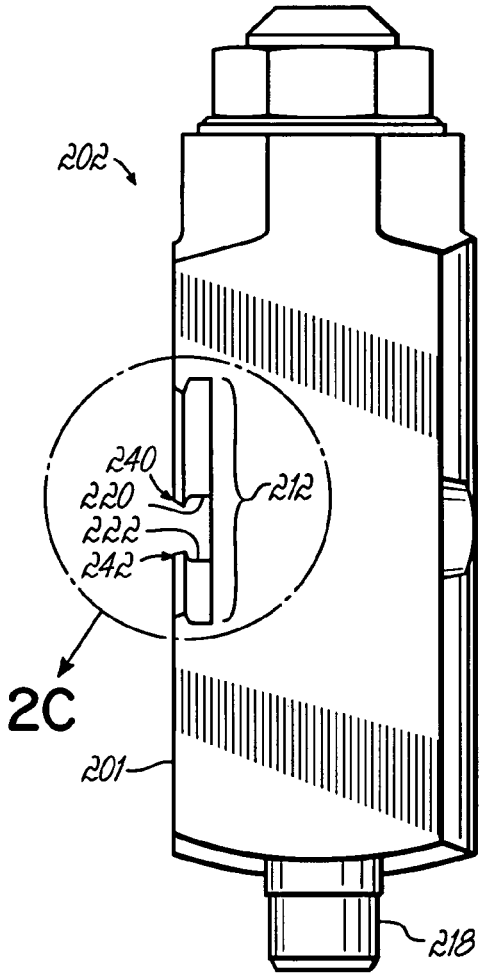
Figure 2C:
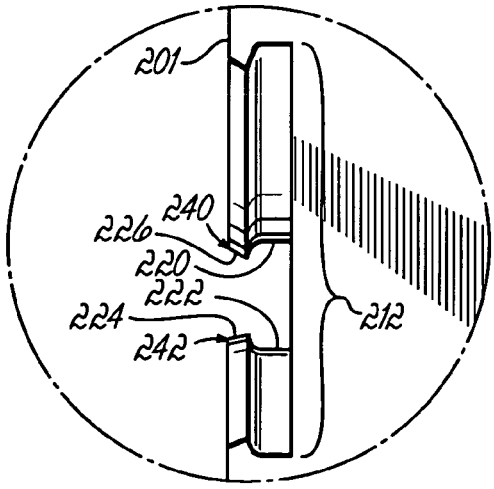

FIGS. 2A-2C illustrate an exemplary module according to another embodiment of the present invention. The following description of the module 202 focuses on its rear face 201 that mates to a gun manifold (not shown) and, in particular, the recessed feature 212. However, it is understood that the gun module 202 may include all the internal and external features typically present in hot melt pneumatic adhesive guns.

The module 202 includes a threaded extension 218 for receiving a nozzle (not shown) for dispensing liquid and a rear face 201 that mates with a gun manifold (not shown). Screw holes 208, 210 are included to permit the module 202 to be attached to the gun manifold. The rear face 201 of the exemplary module 202 of FIG. 2A includes a port 204 to an air passage way and a port 206 to a liquid passageway. In this particular example, each port 204, 206 has a surrounding indentation 214, 216, respectively, that accommodates an O-ring (not shown) between the module 202 and the manifold.

A recessed portion 212 is present between the air port 204 and the liquid port 206. In this exemplary embodiment, the recessed portion 212 resembles a "bow-tie" in that it has a narrow central region that flares outwardly on each side. It will be appreciated that the embodiments shown in FIGS. 3A, 4, 7, 8, 10, 20, 23, 26 and 28 are further examples of bow-tie shapes. Recessed portion 212 includes a top curved portion 240 and a bottom curved portion 242. FIG. 2B provides a side view that highlights the shape of the recessed portion 212 and FIG. 2C provides a detailed view of the recessed portion 212. In particular, the top curved portion 240 includes an undercut region 220 that extends to form a lip 226 while the bottom curved portion 242 includes its own undercut portion 222 that extends to form a lip 224. The lip 226 permits the module 202 to be self-supporting in the vertical direction, as oriented in FIGS. 2A-2C, when it is placed on a gun manifold (not shown) having a complementary projecting portion. Thus, the module 202 will temporarily be retained by, or hang from, the manifold until bolts or other retainers can be inserted in the openings 208 and 210. Opposed surfaces of lips 224, 226 may be chamfered or angled as shown in FIG. 2C to aid in mating the module 202 with another component.

In those instances in which the module may be configured to dispense in an upward direction, it would be coupled to a manifold in an orientation opposite to that of FIG. 2A. Accordingly, in such an orientation, the lip 224 (not lip 226) would interact with a complementary projecting portion of the manifold so as to hold the module 202 on the manifold.

The top curved portion 240 and the bottom curved portion 242 may have the same or may have different radii of curvature. As illustrated in FIGS. 2A-2C, the curved portions 240, 242 have different radii of curvature. Accordingly, the complementary projecting portion of the manifold (not shown) will have appropriately shaped complimentary curved portions. As a result of this asymmetry, the module 202 will properly mate with the manifold in only one orientation. Thus, the recessed portion 212 of the module 202 can be considered "keyed" such that it operates to correctly orient the module 202 and, thereby, prevent an operator from inadvertently flipping the module 202 when attaching it to a manifold. The curved portions 240, 242 also act to properly align the module 202 with the gun manifold. Because of the curved shape, the module is urged towards proper side-to-side alignment. Thus, the openings 204 and 206 will be aligned with their corresponding openings on the gun manifold. Similarly, the bolt holes 208, 210 will be properly aligned as well.

Figure 3A:
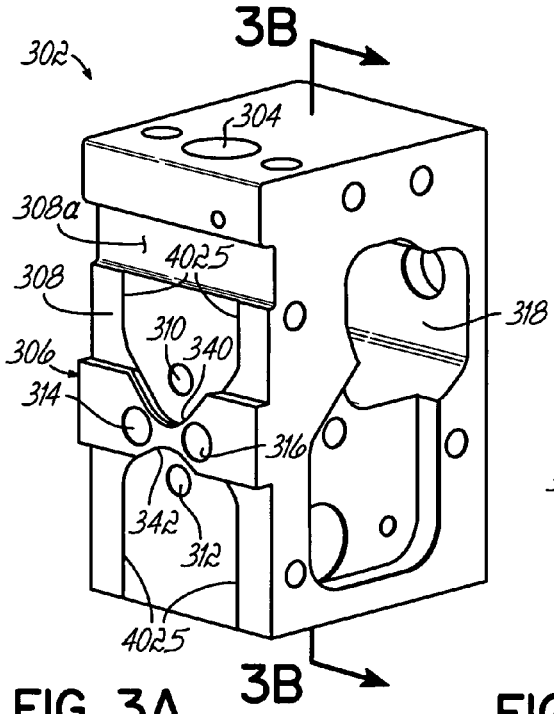
FIGS. 3A-3C illustrate an exemplary gun manifold configured to be coupled with a dispensing module in accordance with principles of the present invention.
Figure 3B:
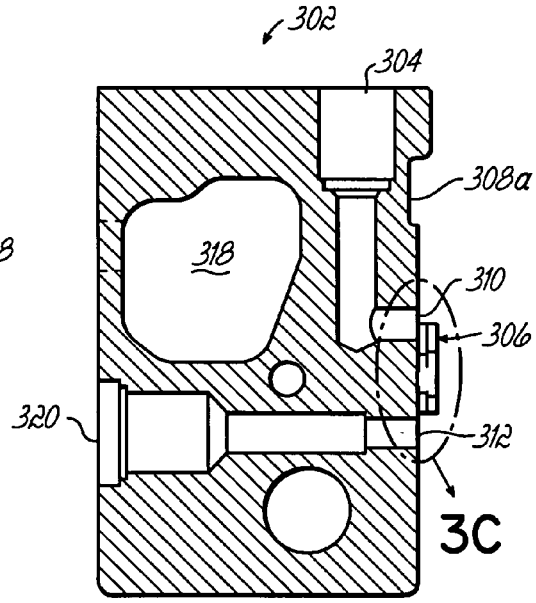
Figure 3C:
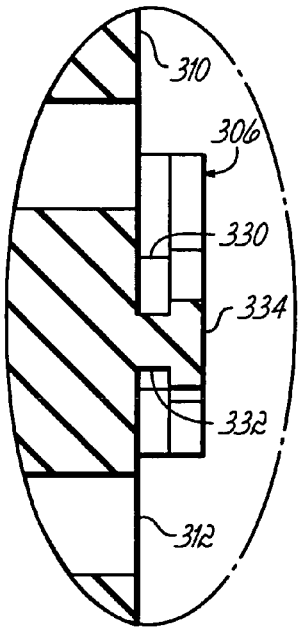

FIGS. 3A-3C illustrate and exemplary gun manifold configured to be coupled with the module of FIGS. 2A-2C in accordance with principles of the present invention. The manifold 302 differs from that of FIG. 1 in that the opening 304 for the air passageway is located on the top of the manifold 302. There is also a region 318 within the manifold for electrical features such as a heating element and controls (not shown).

The manifold 302 includes a front face 308 that mates with a gun module such as one similar to that of FIG. 2A. A recess 308*a* may be provided to accommodate one or more screw heads 202*a* associated with the module. Holes 314 and 316 match similarly placed holes on a gun module and permit bolts or other retaining means to be used to secure the manifold 302 to a gun module. The front face 308 also includes an opening 310 to an air passageway and an opening 312 to a liquid passageway. Through these openings 310, 312, air and liquid, respectively, are introduced into an attached gun module.

A portion 306, projects outwardly from the surface of the front face 308. The exemplary projecting portion 306 of FIG. 3A has a narrow neck that curves outwardly to a thicker wing on each side. Thus, there is a top curved portion 340 and a bottom curved portion 342. Similar to the complementary regions of FIG. 2A, these curved portions 340, 342 are shown with different radii of curvature; however, alternative embodiments contemplate having the same radius of curvature for each curved portion 340, 342.

The side cut-away view of FIG. 3B more clearly shows the profile of the projecting portion 306. This view also illustrates the opening 320 through which liquid, such as adhesive or its precursor, is introduced into the manifold 302. The detailed view of encircled area FIG. 3C shows that the projecting portion 306 includes an undercut portion 330 along its top edge and an undercut portion 332 along its bottom edge. Thus, these undercut portions 330, 332 create a projecting portion 306 that has a "T-shaped" profile 334.

Figure 3D:
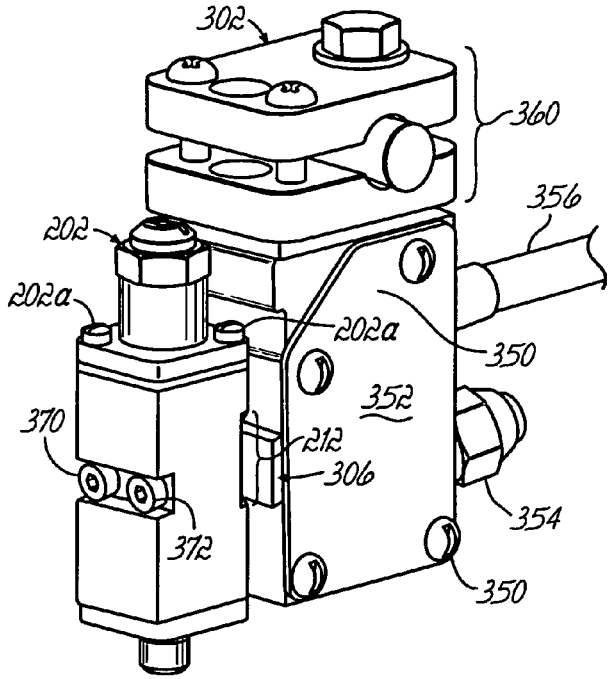
FIG. 3D illustrates an assembly of a dispensing module and the manifold of FIG. 3A.

FIG. 3D illustrates the module 202 and the manifold 302 assembled together. The air connection is not shown; however, an electrical cable 356 and fluid coupling 354 are depicted. Furthermore, a cover 352, secured by bolts 350, is shown that covers the region 318 and an exemplary gun mounting assembly 360 is depicted as well. When the module 202 is placed on the manifold 302, its recessed portion 212 cooperates with the projecting portion 306 so that the module is retained by, or hangs from, the manifold 302. While in such a position, an operator can attach bolts 370 and 372 to more permanently secure the module 202 to the manifold 302.

FIGS. 4-11 depict a number of variations of how the rear face of a gun module can be shaped so that it interacts with a complementary front face of a manifold. Although, the assemblies within this series of figures are being referred to as examples of a module, these shapes could just as easily be used as examples for the manifold or other liquid dispensing components. The present invention contemplates an interface between the module and the manifold that permits the module to be retained by, or hang from, the manifold. The exemplary shapes of FIGS. 4-11 will permit such hanging of the module, regardless of whether they are implemented on the manifold or the module. Additionally, these figures do not explicitly illustrate the complementary surfaces that would interact with the illustrated examples, as one of ordinary skill would recognize that any complementary surface would include an appropriately shaped projecting portion corresponding to each illustrated recessed portion and an appropriately shaped recessed portion corresponding to each illustrated projecting portion.

Similar to the exemplary modules described earlier, the module 402 of FIG. 4 includes an air opening 204 and a liquid opening 206 along with bolt holes 208 and 210. In fact, all the various modules hereinafter described include these features even if not explicitly described. The portion 412 surrounding the air opening 204 is sized to fit an O-ring or other gasket (not shown). Similarly, the region 408 surrounding the liquid opening 206 is sized for an O-ring (not shown) as well. However, the region 408 includes an annular protrusion 410 immediately surrounding the opening 206. In some instances, liquid passing through the opening 206 may attach to the O-ring and act to dislocate the O-ring or to pull it within the opening 206. The annular protrusion 210 separates the liquid and the O-ring thereby ensuring that the O-ring remains in position. The indented regions 412 and 408 may be formed so as not to substantially contribute to retaining the module 402 on a manifold (not shown) or they can be cut into the module 402 to a depth that does interact with a corresponding annular protuberance on the manifold so as to provide additional resting surfaces on which to hang the module 402. The recessed portion 404 of FIG. 4 resembles the bow-tie shape 212 of FIG. 2A that helps properly align the openings 204, 206 of the module 402. As explained earlier, the recessed portion 404 may also be "keyed" so as to prevent the module 402 from being improperly positioned on a gun manifold (not shown). The recessed portion 404 of the module 402 of FIG. 4, and the other alternative embodiments of FIGS. 5-24, may include a lip portion (such as shown in FIG. 2C) or may have a smooth profile.

Figure 5:
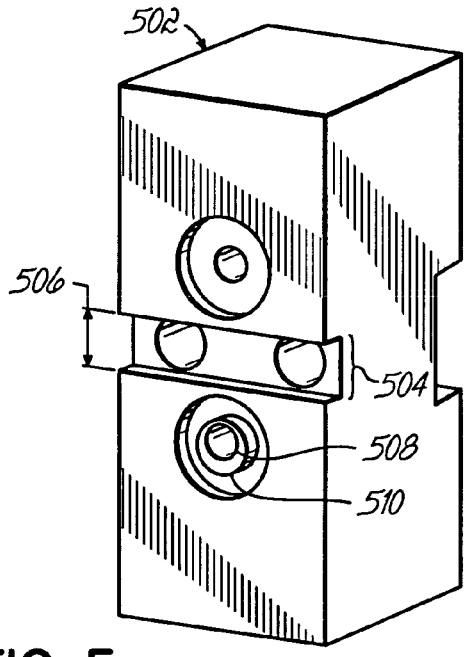
Figure 6:
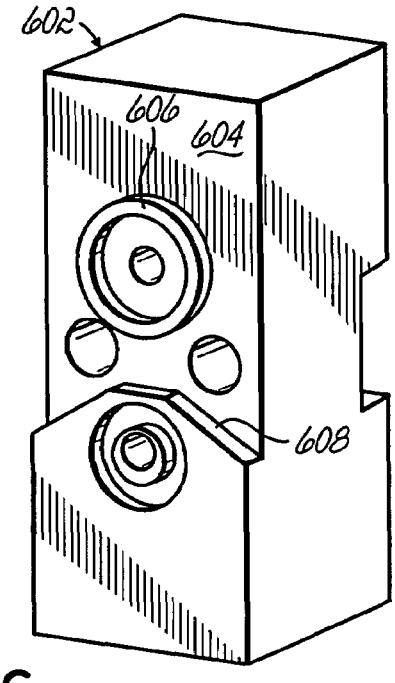

The module 502 of FIG. 5 illustrates a recessed portion 504 that is a horizontally extending region having substantially the same width 506 along its entire length. In FIG. 6, the module 602 includes a recessed portion 604 substantially along its entire top half. As a result, the angled surface 608 appears to protrude from the module 602. This angled surface 608 would effectively interact with a corresponding protruding portion on a manifold if the module 602 was placed in an orientation such that it dispensed upwards. The annular portion 606 provides a mating surface between the module 602 and a manifold (not shown). When bolted together as an assembly, the surface 606 would form a seal with the manifold.

Figure 7:
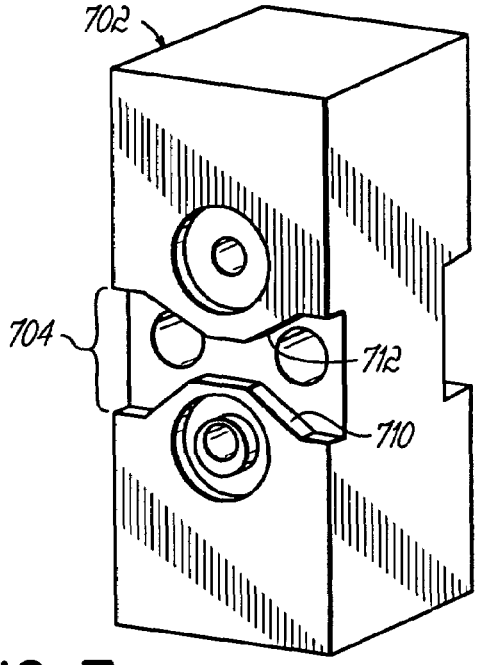
Figure 8:
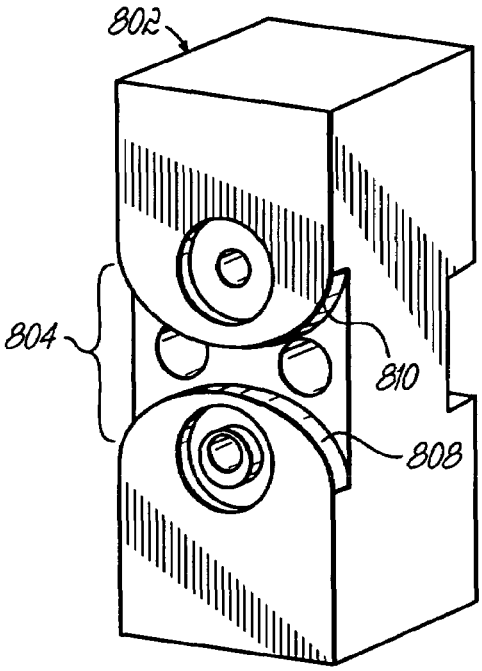
Figure 9:
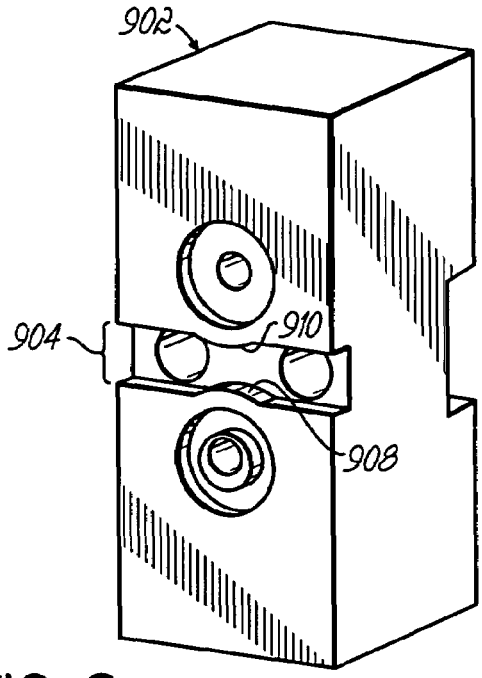
Figure 10:
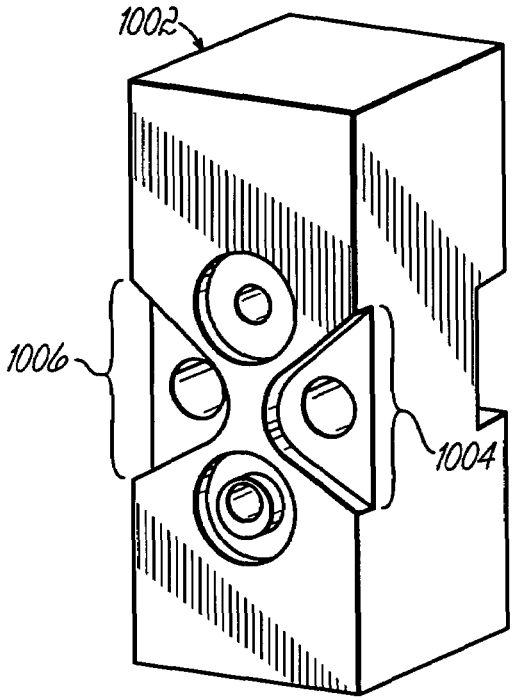

The module 702, of FIG. 7, includes a recessed portion resembling a bow-tie as well. However, instead of smoothly curved portions, the recessed portion 704 is defined by angled portions 710 and 712. As before, these angled portions 710, 712 may be shaped different from one another to provide a "keyed" module. The module 802 of FIG. 8 has a recessed portion 804 in which the curved portions 808, 810 are more circular than previously described bow-tie recessed portions. The module 902 of FIG. 9 resembles the horizontally extending region 504 of FIG. 5 but includes the additional features 908 and 910. These features 908 and 910 provide a relatively small indent into the recessed portion 904. As a result, the module 902 will automatically be urged into alignment when placed on a complimentary manifold (not shown). In FIG. 10, the exemplary module 1002 includes two recessed portion 1004 and 1006 positioned side-by-side that flare outwardly towards the sides of the module 1002.

Figure 11:
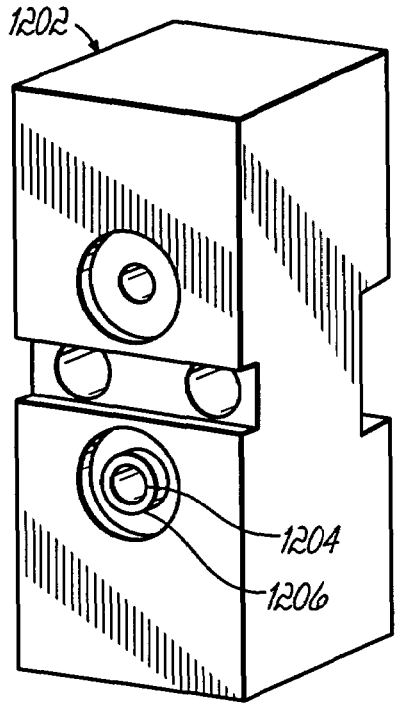

The module of FIG. 11 is substantially similar to that of FIG. 5 except for the location of the respective liquid openings. The liquid opening 508 of the module 502 (FIG. 5) is located off-center to the annular region 510 similar to opening 206 in annular region 410 shown in FIG. 4. In contrast, however, in FIG. 11, the liquid opening 1204 is centered within the surrounding annular region 1206.

In many of the configurations illustrated herein, the manifold will include a complementary shaped projecting portion. When the manifold and the module are coupled together, this projecting portion separates the air port and the liquid port. More particularly, the projecting portion and recess portion create a dam-like structure between the two ports. Thus, even if an O-ring should fail or liquid should leak from the manifold, the dam will help prevent the adhesive from reaching the air port and damaging the module. Additionally, the recessed portions may be shaped to provide exit paths for any liquid that might escape from the liquid port. In particular, as these recessed portions are sloped downwards from their centers, any liquid entering the channel would have a tendency to migrate outwardly to the edges of the modules and not towards the air port.

One embodiment of the present invention relates to a dispensing module that can continue to interact with legacy, or old style, gun manifolds. These manifolds typically have a smoothly machined front surface that mates to a smoothly machined rear face of a dispensing module. As modules with hanging features become more popular, it is still worthwhile to have these new types of modules interact with an old-style manifold.

Figure 12A:
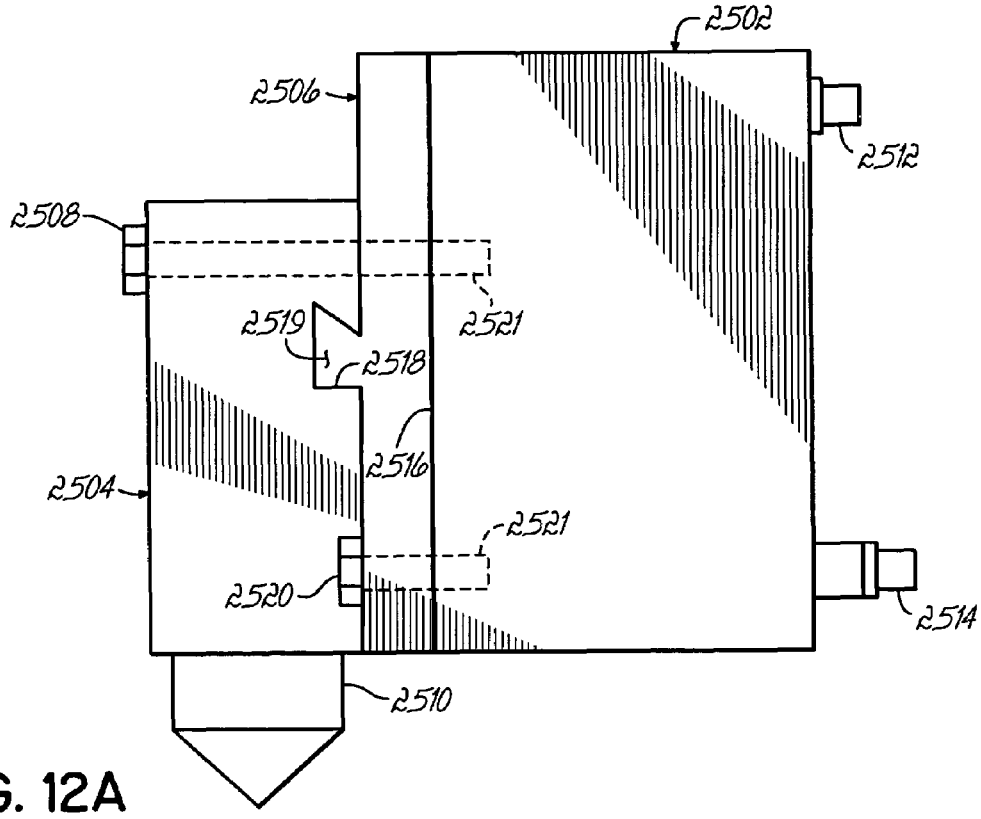
FIG. 12A illustrates an assembly having an adaptor according to an embodiment of the present invention to hang a module from a manifold having a smooth front face.

A legacy manifold 2502 is depicted in FIG. 12A having a smooth front face 2516 with no projecting portions. This manifold 2502 includes, along with a number of other features not shown, an air supply connector 2512 and a liquid supply connector 2514. The module 2504 includes a rear face having a recessed portion 2518 and a dispensing nozzle 2510. This recessed portion 2518 does not necessarily interfere with the module 2504 being securely fastened to the manifold 2502. The module 2504 may simply be mounted to the manifold 2502 using one or more bolts 2508 such that the smooth contacting surfaces, and O-rings if present, sealingly couple the module 2502 and manifold 2504. This arrangement, however, would not take benefit of the retaining, or hanging, feature offered by the module 2504.

Figure 12B:
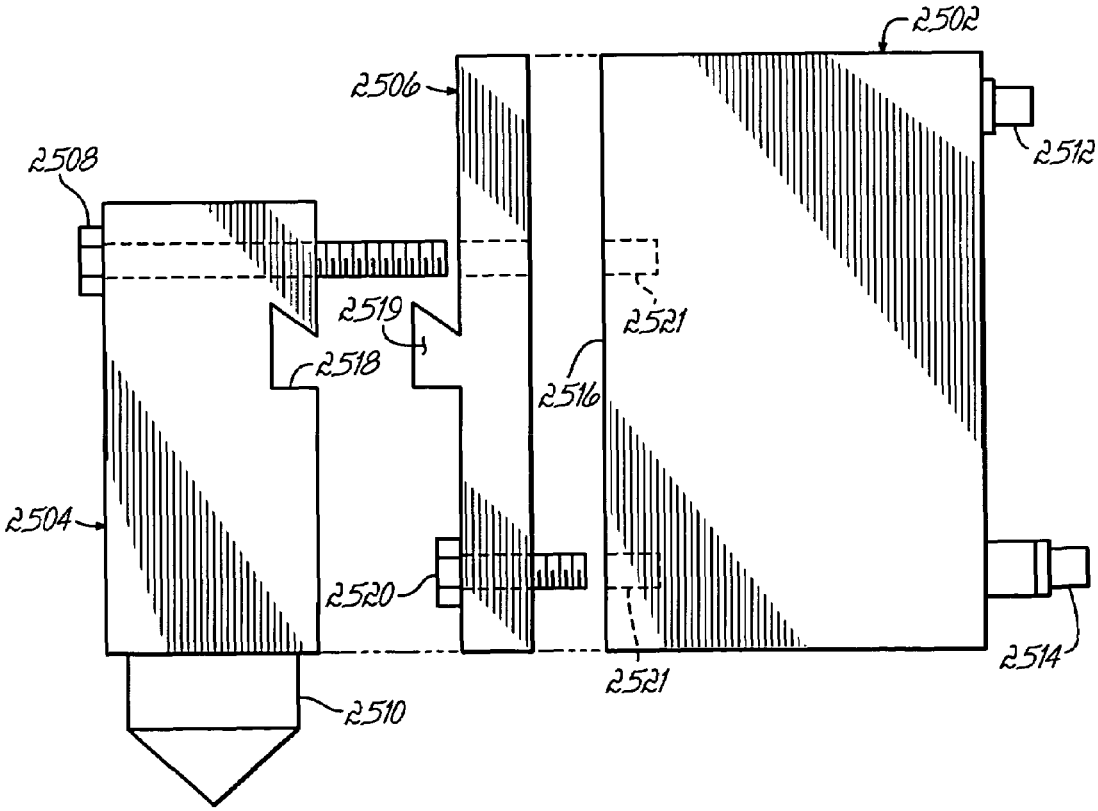
FIG. 12B illustrates an exploded view of the assembly of FIG. 12A.

An adaptor 2506 can be used, therefore, in between the manifold 2502 and the module 2504. The adaptor 2506 attaches to the manifold 2502 and provides a projecting portion 2519 on which to hang or otherwise at least partially support one or more modules 2504. Typically, the adaptor 2506 would utilize a bolt 2520 and one or more existing mounting holes 2521 to connect with the manifold 2502. For example, the adaptor 2506 could use the original holes used to mount a module while providing alternative holes which a module could then use. One of ordinary skill would envision many alternative ways to connect one or more modules 2504, the adaptor 2506, and the manifold 2502, including the use of a long bolt 2508 through at least one of the original mounting holes 2521. Similar to the arrangement in FIG. 1, recessed portion 2518 is shaped complementary to the projecting portion 2519 and permits the module 2504 to hang from the manifold 2502. In this way, a new style module 2504 can operate with an older-style manifold 2502. FIG. 12B shows an exploded view of the assembly of FIG. 12A.

Figure 13A:
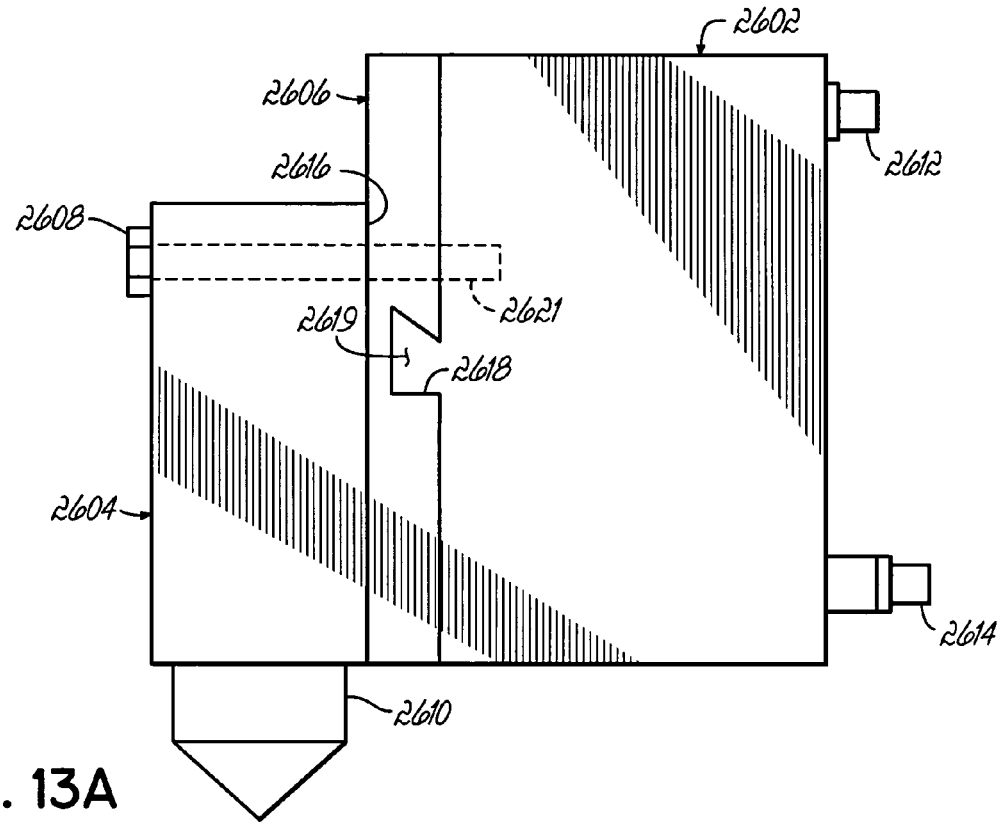
FIG. 13A illustrates an assembly having an adaptor according to another embodiment of the present invention to hang a module having a smooth rear face on a manifold.
Figure 13B:
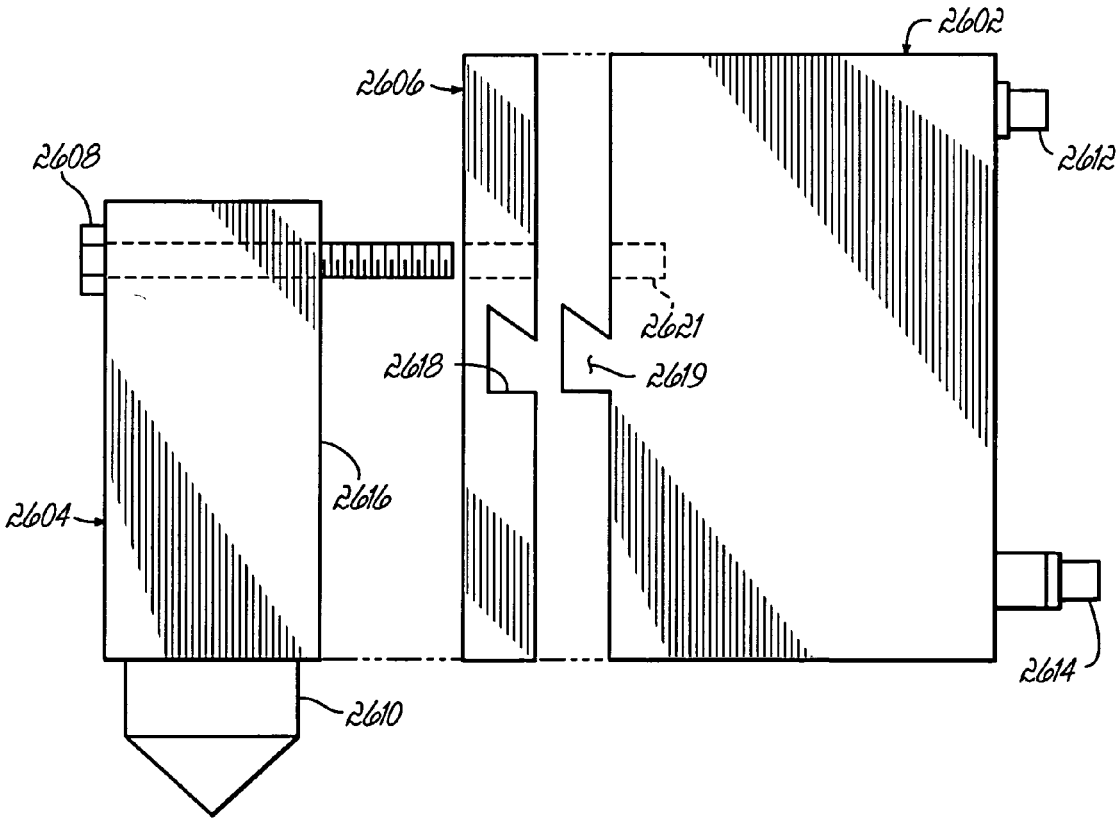
FIG. 13B illustrates an exploded view of the assembly of FIG. 13A.
Figure 14:
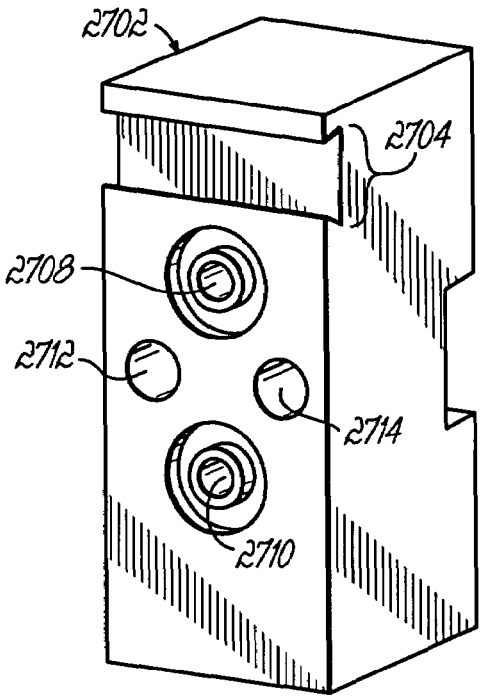
FIGS. 14-19 illustrate alternative embodiments of the present invention in which a recess in the gun module face is not located between the air port and a liquid port.

As alternative to the adaptor 2506 of FIG. 12A, the adaptor 2606 of FIG. 13A can be used to permit a new style manifold 2602 to be used with an older style module 2604. The older style module 2604 includes a dispensing nozzle 2610 and a smooth rear face 2616 with no recessed region. In this instance, the adaptor 2606 includes a recessed portion 2618 that matches a projecting portion 2619 on the front face of the manifold 2602. As seen before, the recessed portion 2618 permits the module 2604 to temporarily be retained by, or hang from, the manifold 2602. In operation, for example, the module 2604 is connected with the adaptor 2606 through one or more bolts 2608. The module 2604 and the adaptor 2606 is then hung from the projecting portion 2619 so that the bolt 2608 can be fully tightened within the passageway, or mounting hole, 2621. Accordingly, in this manner, older-style modules 2604 can be modified to operate with newer-style manifolds 2602. Alternatively, the original bolts associated with module 2604 may be replaced with longer bolts and components 2602, 2604 and 2606 may be stacked or assembled as shown in FIG. 13A and new longer bolts may be used to secure them together. FIG. 13B illustrates an exploded view of the assembly of FIG. 13A.

The adaptors 2506 and 2606 of FIGS. 12A and 13A may be shaped so as to conform to any of the recessed shapes (or complimentary projecting portions) illustrated herein for purposes of supporting liquid dispensing components such as modules, manifolds, adaptors, or any other similar components. Thus, with the use of the appropriate adaptor, legacy equipment can be adapted so as to provide the dam-like structure to prevent contamination of the air passageway with liquid, the keying feature to prevent mis-orienting a module on a manifold, and the self-alignment feature to align the corresponding passageways of the manifold and module. In addition, adaptors constructed in accordance with the invention may be used to allow easy changeover of multiple modules coupled with a single adaptor with other modules on another adaptor which may be different in number and/or spacing, for example.

Figure 15:
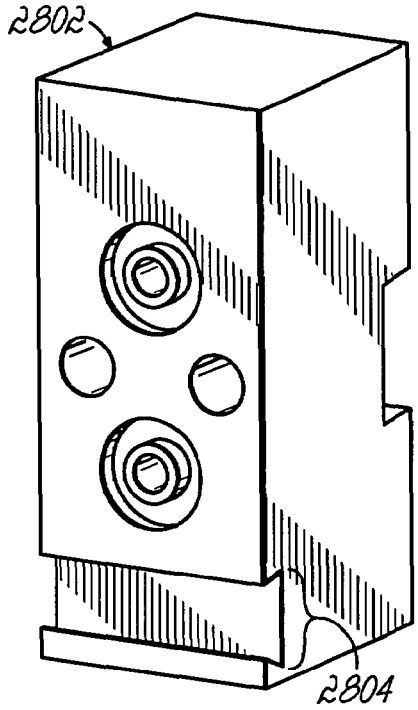
Figure 16:
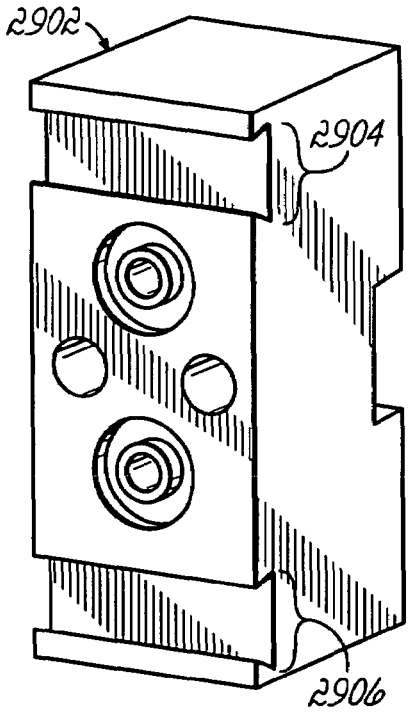

In the previously described embodiments, the recessed portions of the various modules have been located between the air port and the liquid port. However, other embodiments of the present invention contemplate locating the recessed region in other portions of a module's rear face as well. For example, the module 2702 of FIG. 14 includes a recessed portion 2704 located near the top of the module 2702. As before, the module 2702 includes an air port 2708, a liquid port 2710 and bolt holes 2712, 2714. In this example, however, the recessed portion 2704 is not located between the ports 2708, 2710. As recessed portion 2704 will interact with a complimentary projecting portion of a manifold (not shown) to permit the module 2702 to be retained by, or to hang from, the manifold. The profile shape of the recessed portion 2704 resembles a dovetail having edges that flare away from each other; however, alternative embodiments may include a recessed portion having edges substantially parallel with one another. FIG. 15 depicts a module 2802 having a recessed portion 2804 similar in shape to that of recessed portion 2704 but located near the bottom of the module 2802 instead of the top. FIG. 16 illustrates a module 2902 having two recessed portions 2904 and 2906 located at opposite ends of the module 2902. The profiles of the recessed portions 2904 and 2906 may be similar or may be different so as to prevent mis-orienting the module 2902.

Figure 17:
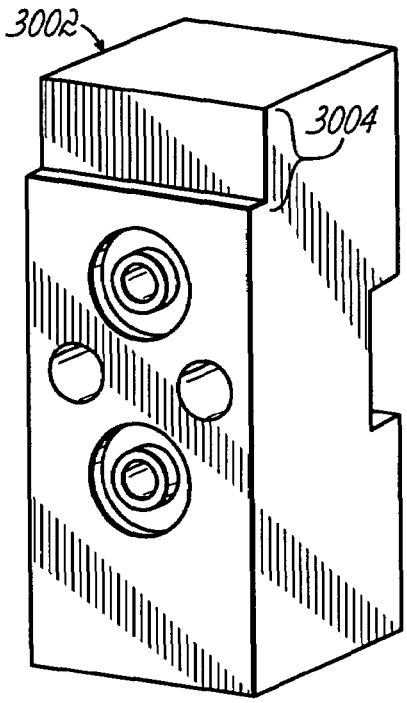
Figure 18:
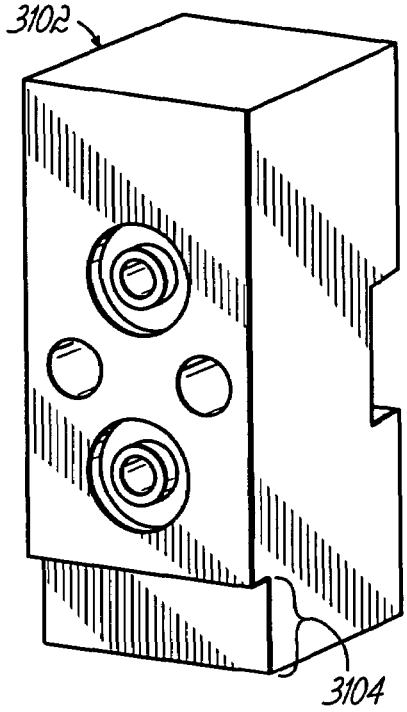
Figure 19:
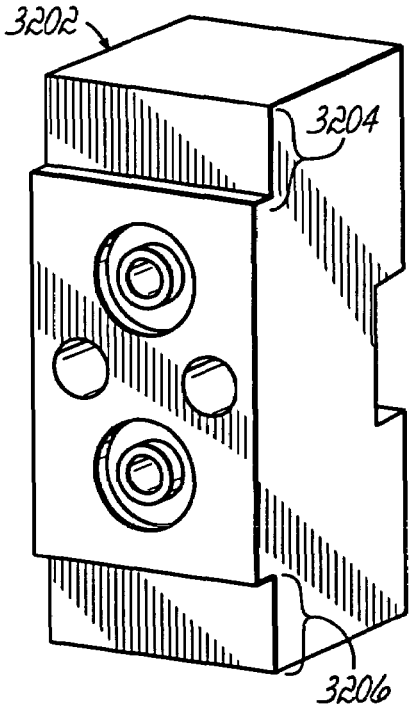

The modules of FIGS. 17-19 include recessed portions that are "rabbet shaped". The module 3002, of FIG. 17, includes the rabbet portion 3004 along its top edge while the module 3102, of FIG. 18, includes the rabbet portion 3104 along its bottom edge. The module 3202, of FIG. 19, includes one rabbet 3204 along its top edge as well as another rabbet 3206 along its bottom edge. These rabbet portions are configured to receive complementary shaped projecting portions on a manifold (not shown) in accordance with the inventive principles.

Figure 20:
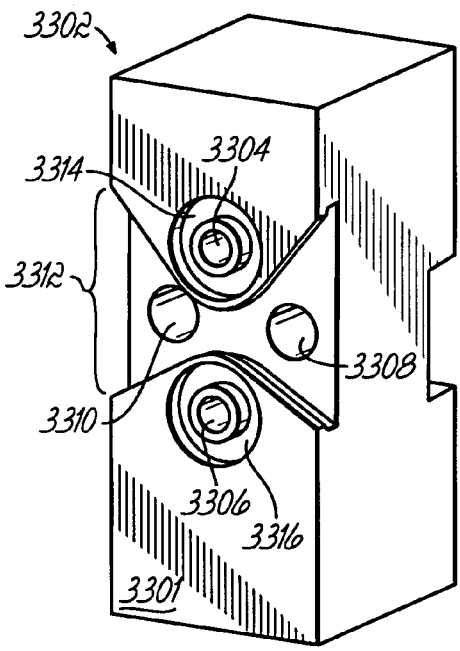
FIGS. 20-22 illustrate an exemplary module according to an alternative embodiment of the present invention.
Figure 21:
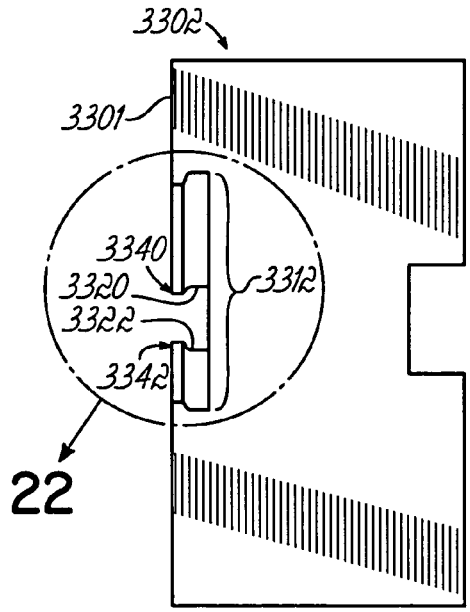
Figure 22:
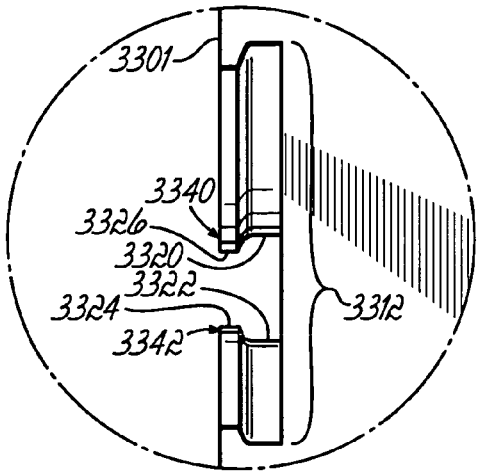

FIGS. 20-22 illustrate an exemplary module according to another embodiment of the present invention. The following description of the module 3302 focuses on its rear face 3301 that mates to a gun manifold (not shown) and, in particular, the recessed feature 3312. However, it is understood that the gun module 3302 may include all the internal and external features typically present in hot melt pneumatic or electric adhesive guns.

The module 3302 includes screw holes 3308, 3310 to permit the module 3302 to be attached to the gun manifold. The rear face 3301 of the exemplary module 3302 includes a port 3304 to an air passageway and a port 3306 to a liquid passageway. In this particular example, each port 3304, 3306 has a surrounding indentation 3314, 3316, respectively, that accommodates an O-ring (not shown) between the module 3302 and the manifold.

A recessed portion 3312 is present between the air port 3304 and the liquid port 3306. In this exemplary embodiment, the recessed portion 3312 resembles a "bow-tie" in that it has a narrow central region that flares outwardly on each side. Thus, there is a top curved portion 3340 and a curved bottom portion 3342. FIG. 21 provides a side view that highlights the shape of the recessed portion 3312 and FIG. 22 provides a detailed view of the recessed portion 3312. In particular, the top curved portion 3340 includes an undercut region 3320 that extends to form a lip 3326 while the bottom curved portion 3342 includes its own undercut portion 3322 that extends to form a lip 3324. The lip 3326 permits the module 3302 to be self-supporting in the vertical direction, as oriented in FIGS. 20-22, when it is placed on a gun manifold (not shown) having a complementary projecting portion. Thus, the module 3302 will temporarily be retained by, or hang from, the manifold until bolts or other retainers can be inserted in the openings 3308 and 3310.

The module 3302 is substantially similar to the module 202 of FIGS. 2A-2C except for the lips 3326 and 3324. Referring back to FIGS. 2A-2C, the analogous lip 224, 226 slant away from the rear face 201. The module 3302 has lips 3324, 3326 that are substantially perpendicular to the face 3301 of the module 3301. If used with a manifold having a complimentary shaped projecting portion, the relatively flat surface of the lips 3324, 3326 provide more surface area to frictionally engage the manifold than the slanted lips 224, 226.

In those instances in which the module may be configured to dispense in an upward direction, it would be coupled to a manifold in an orientation opposite to that of FIG. 20. Accordingly, in such an orientation, the lip 3324 (not lip 3326) would interact with a complementary projecting portion of the manifold so as to hold the module 3302 on the manifold.

The top curved portion 3340 and the bottom curved portion 3342 may have the same or may have different radii of curvature. As illustrated in FIGS. 20-22, the curved portions 3340, 3342 have different radii of curvature. Accordingly, the complementary projecting portion of the manifold (not shown) will have appropriately shaped complimentary curved portions. As a result of this asymmetry, the module 3302 will properly mate with the manifold in only one orientation. Thus, the recessed portion 3312 of the module 3302 can be considered "keyed" such that it operates to correctly orient the module 3302 and, thereby, prevent an operator from inadvertently flipping the module 3302 when attaching it to a manifold. The curved portions 3340, 3342 also act to properly align the module 3302 with the gun manifold. Because of the curved shape, the module is urged towards proper side-to-side alignment. Thus, the openings 3304 and 3306 will be aligned with their corresponding openings on the gun manifold. Similarly, the holes 3308, 3310 will be properly aligned as well.

Figure 23:
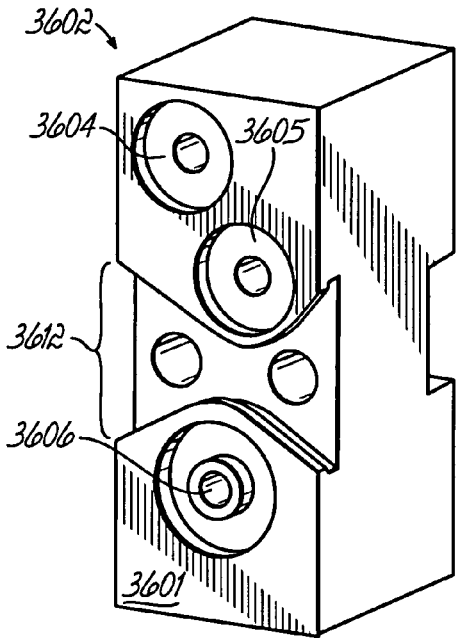
FIGS. 23 and 24 illustrate a perspective view and a side view, respectively, of an exemplary module according to yet another embodiment of the present invention.

FIG. 23 illustrates an exemplary module according to another embodiment of the present invention. The module 3602 is similar in many respects to the module 3302 of FIG. 20; accordingly, most of the features of module 3602 will only be briefly described. The rear face 3601 of the exemplary module 3602 includes a port 3604 to one air passageway and a second port 3605 to another air passageway. In some dispensing modules, a piston is actuated by pressurized air so as to move the piston in one direction. The movement of the piston is translated into movement of a needle within the module so as to control dispensing of liquid from the module. In such a module, a spring is typically provided that urges the piston in an opposite direction. As an alternative, a dispensing module may include a piston that does not use a spring but, instead, uses respectively applied air to move the piston in both the up and down direction. The module 3602 is an example of the latter type of dispensing module and, therefore, includes the port 3604 to provide air to move the piston down and the port 3605 to provide air to move the piston up. As in the previous embodiments, a port 3306 is included to a liquid passageway. In this particular example, each port 3604, 3605, 3606 has a surrounding indentation, respectively, that accommodates an O-ring (not shown) between the module 3602 and the manifold.

Figure 24:
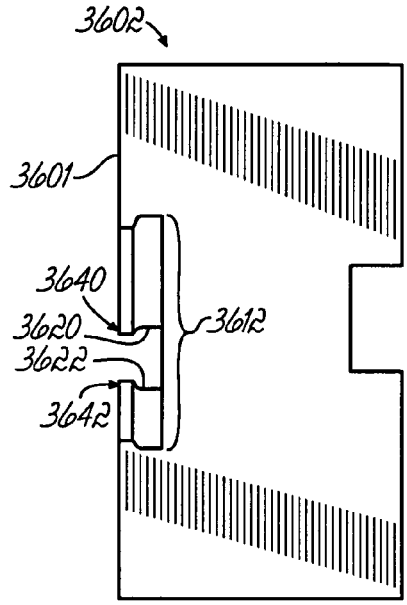

A recessed portion 3612 is present between the air ports 3604, 3605 and the liquid port 3606. The recessed portion 3612 is substantially similar to the "bow-tie" portion 3312 described earlier. Thus, there is a top curved portion 3640 and a bottom curved portion 3642. In particular, the top curved portion 3640 includes an undercut region 3620 that extends to form a top lip while the bottom curved portion 3642 includes its own undercut portion 3622 that extends to form a bottom lip. Similar to the lips 3324, 3326 of FIG. 22, the top and bottom lips of the module 3602 are substantially perpendicular to the face 3601 as shown in FIG. 24. However, use of lips similar to the slanted lips 224, 226 is contemplated as well.

Figure 25:
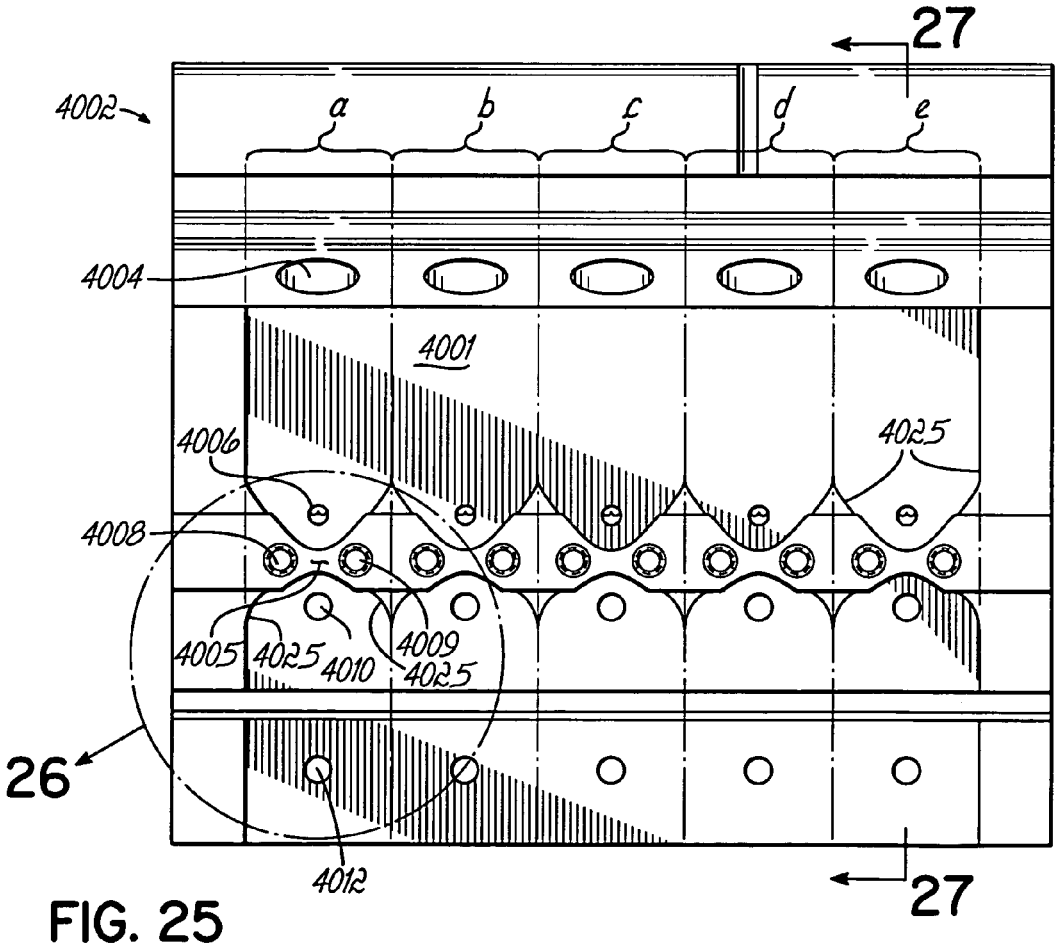
FIGS. 25-27 illustrate an exemplary manifold that is adapted for use with multiple dispensing modules.

FIG. 25 illustrates a manifold 4002 that is adapted for use with multiple dispensing modules. An exemplary application of such a manifold 4002 would be in the production of non-woven materials such as that used in manufacturing diapers. The manifold 4002 includes five sections (a, b, c, d, e and f) that may be substantially the same. One of ordinary skill will recognize that fewer or more sections may be used to accommodate a number of different modules. The features of section a are explicitly described below; however, each of the other section b-f have similar features as well. An opening or port 4004 is provided that receives pressurized air and provides it in a controlled manner to a dispensing module via a port 4006. Port 4010 is a liquid port that supplies liquid, such as hot melt adhesive, to a dispensing module. The port 4012 also supplies air to the dispensing module. However, this air is not typically used to actuate the dispensing of liquid but, instead, is used to affect the characteristics of the liquid being dispensed such as, for example, swirl-air. One of ordinary skill will recognize that the described ports for liquid and air are exemplary in nature and different configurations as known in this art may be used without departing from the scope of the present invention. For example, additional ports may be included to allow recirculation of liquid from the dispensing module.

Attachment holes 4008 and 4009 are included on the manifold 4002 to permit a dispensing module to be bolted, or otherwise attached, to the manifold 4002. In addition, a projecting portion 4005 is provided that engages a complimentary shaped recessed portion of the dispensing module. In this way, the projecting portion 4005 supports the dispensing module in a vertical direction even before bolts are used to attach the dispensing module to the manifold 4002.

Figure 26:
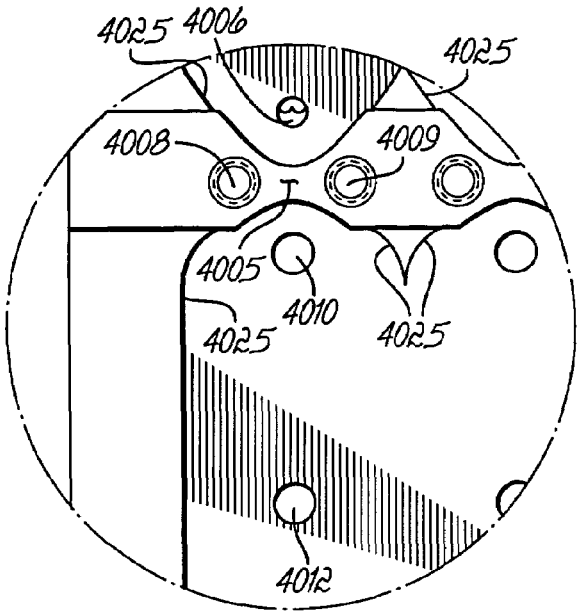

FIG. 26 is a detailed view of the projecting portion 4005 and illustrates that the projecting portion 4005 has a bow-tie shape as described previously herein that includes two different radii of curvature in order to provide a "keyed" operation. Five of these projecting portions are depicted in FIG. 25, thereby allowing five different dispensing modules to be attached to the manifold 4002.

Figure 27:
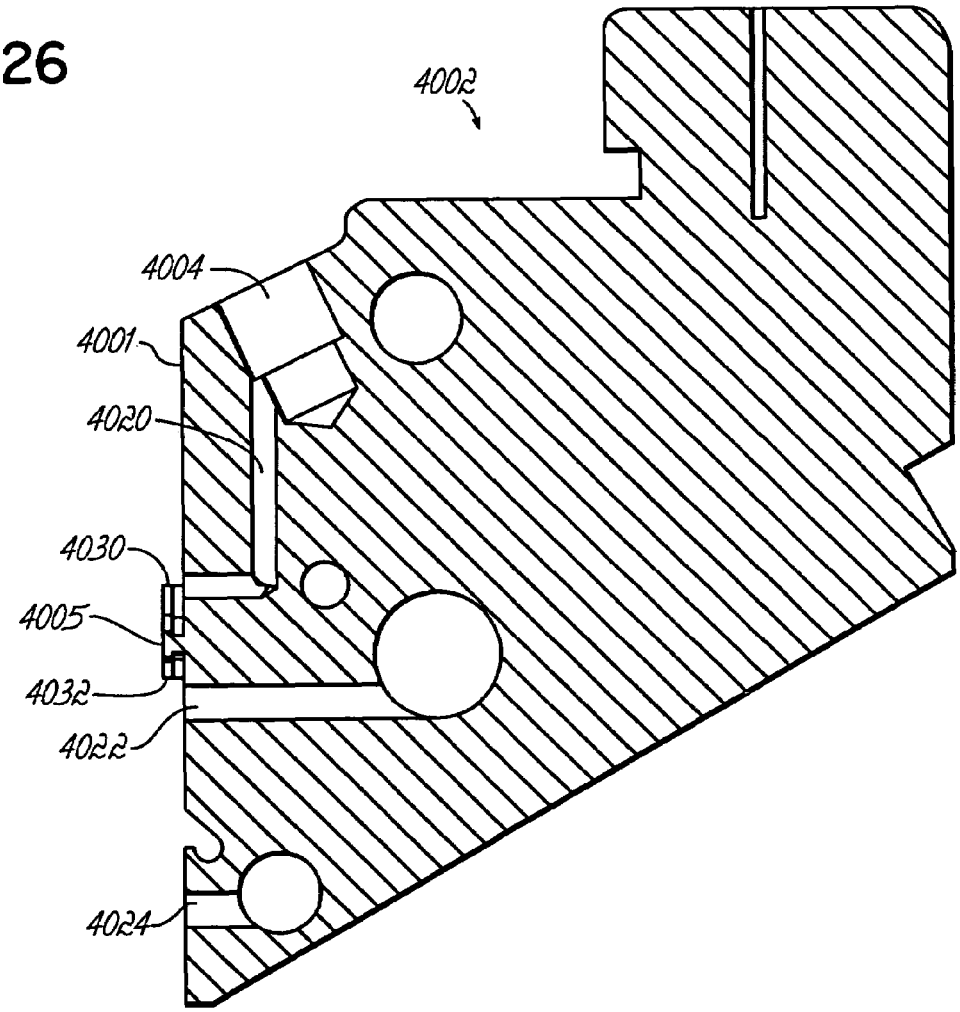

FIG. 27 shows a cross-section view of the manifold 4002. In this cross-sectional view, passageways to the different ports are depicted. For example passageway 4020 communicates with port 4006, passageway 4022 communicates with port 4010, and passageway 4024 communicates with port 4012. The profile of the projecting portion 4005 is depicted in FIG. 27 and includes an upper surface 4030 and a lower surface 4032 that projects outwardly from, and substantially parallel to, the face 4001 of the manifold 4002.

The exemplary manifolds and modules described herein may be manufactured in a variety of ways. For example, a manifold such as that of FIG. 3A may initially be formed with a rectangular ledge that protrudes from the face 308. Subsequent, separate fabrication steps machine the face 308 so that it is within tolerances to sealingly mate with a dispensing module and machine the ledge to create the profile of the projecting portion 306 as shown in FIG. 3C.

Figure 28:
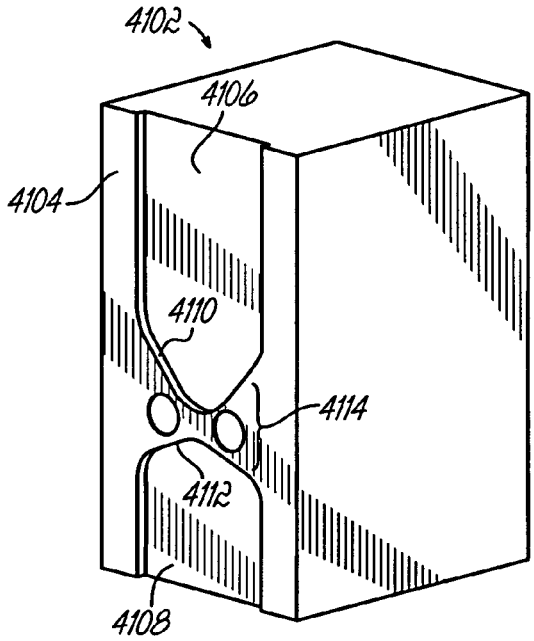
FIG. 28 illustrates an exemplary manifold fabricated in accordance with the principles of the present invention.

FIG. 28 depicts a manifold with a projecting portion manufactured according to an alternative fabrication method. In particular, manifold 4102 initially includes a face 4104 having a substantially flat surface. During the manufacturing process, material is machined away from the face 4104 to create an upper recessed region 4106 and a lower recessed region 4108. These regions 4106, 4108 correspond to the surfaces which will mate with a dispensing module. Removal of the material effectively creates a projecting portion 4114 having an upper lip 4110 and a lower lip 4112. During the removal process, the profile of the upper and lower lips 4110, 4112 can be machined as well to create the features described herein, for example, with respect to FIG. 3C. As a result the manufacturing process for forming the projecting portion of the manifold is simplified, improved, and more economical.

Additionally, the machined portion 4025, as shown in FIGS. 3A, 25 and 26, on the manifold is formed according to the fabrication method used to produce the recessed region (308 in FIG. 3A and 4001 in FIG. 38) within allowable tolerance. Portion 4025 is not formed however when alternative machining methods and/or cutting tools are followed such as in FIG. 28.

While the present invention has been illustrated by a description of various preferred embodiments and while these embodiments has been described in some detail, it is not the intention of the Applicant to restrict or in any way limit the scope of the appended claims to such detail. Additional advantages and modifications will readily appear to those skilled in the art. The various features of the invention may be used alone or in numerous combinations depending on the needs and preferences of the user. This has been a description of the present invention, along with the preferred methods of practicing the present invention as currently known.

What is claimed is:

1. An apparatus for dispensing liquid thermoplastic material comprising:

a first component including a first side and at least one passageway for receiving the liquid thermoplastic material, said passageway including an opening on said first side and said first component further including a first interactive surface on said first side and configured as one of a recessed portion extending only partially into said first component and spaced from said opening or a projecting portion configured to extend only partially into a second component and spaced from said opening, said first interactive surface adapted to cooperate with a second interactive surface on the second component and thereby capable of either at least partially supporting said first component on the second component or at least partially supporting the second component on said first component.

2. The apparatus of claim 1, wherein said first component is a gun manifold configured to carry a dispensing module on said first side.

3. The apparatus of claim 2, further comprising said second component, wherein said second component is a dispensing module including a second interactive surface complementary to said first interactive surface and configured such that said first interactive surface and said second interactive surface cooperate so that said dispensing module is at least partially supported on said gun manifold.

4. The apparatus of claim 1, wherein said first component is a dispensing module including a valve for selectively dispensing the liquid thermoplastic material.

5. The apparatus of claim 1, wherein said first interactive surface is asymmetrically shaped such that the first and second interactive surfaces cooperate for self-supporting one of said first and second components on the other of said first and second components when said first component is oriented in a first orientation and said first and second interactive surfaces do not cooperate for self-supporting one of said first and second components on the other of said first and second components when said first component is oriented in a second orientation opposite to said first orientation.

6. The apparatus of claim 1, further comprising said second component having a second interactive surface, and wherein said first interactive surface and said second interactive surface cooperate so that said first component is self-supported on said second component.

7. The apparatus of claim 6, wherein:

said first component further comprises a first air port; and said second component further comprises a second air port;

wherein, when said first and second interactive surfaces are in cooperation, said first air port communicates with said second air port.

8. The apparatus of claim 7, wherein:

said first interactive surface includes asymmetrically curved surfaces such that the first and second interactive surfaces cooperate only when said first air port is aligned with said second air port.

9. The apparatus of claim 8, wherein said asymmetrically curved surfaces further comprise opposed curvilinear surfaces having different radii of curvature.

10. The apparatus of claim 7, wherein said first interactive surface and said second interactive surface further cooperate to align said first and second air ports.

11. The apparatus of claim 1, wherein said first component is an adaptor configured to be positioned generally between a dispensing module and a manifold.

12. The apparatus of claim 1, wherein said first interactive surface further comprises opposed curvilinear surfaces defining a recessed space therebetween for receiving a projecting portion at least partially defined by the second interactive surface.

13. The apparatus of claim 1, wherein said first interactive surface further comprises opposite curvilinear surfaces defining a projecting portion therebetween, said projecting portion configured to be received in a recessed space at least partially defined by the second interactive surface.

14. The apparatus of claim 1, wherein said recessed portion and said projecting portion are each generally bow-tie shaped.

15. The apparatus of claim 1, wherein said recessed portion and said projecting portion have shapes selected from the group consisting of:

(a) a rectangle, (b) a plurality of angled surface portions, (c) a generally rectangular shape with opposed curved portions, and (d) a dove-tail.

16. The apparatus of claim 1, wherein said first interactive surface further comprises a projecting portion having a first undercut forming a first lip.

17. The apparatus of claim 16, further comprising a second undercut forming a second lip in opposed relation to said first lip.

18. The apparatus of claim 17, wherein said first and second lips have opposed, chamfered surfaces.

19. An apparatus for dispensing liquid thermoplastic material comprising:

a first component comprising a first face, said first face including a first interactive surface formed as a recessed portion extending only partially into said first component, and a first liquid port spaced from said first interactive surface, and a second component comprising a second face, said second face including a second interactive surface complementary to said first interactive surface and a second liquid port, said second interactive surface formed as a projecting portion, wherein said recessed portion and said projecting portion cooperate to align said first and second liquid ports and to at least partially support one of said first and second components on the other of said first and second components.

20. The apparatus of claim 19, wherein said first component is a gun manifold.

21. The apparatus of claim 19, wherein said second component is a dispensing module.

22. The apparatus of claim 19, wherein said first component is a dispensing module.

23. The apparatus of claim 19, wherein said second component is a gun manifold.

24. The apparatus of claim 19, wherein said first and second interactive surfaces are asymmetrically shaped such that the first and second interactive surfaces cooperate for self-supporting one of said first and second components on the other of said first and second components when said first component is oriented in a first orientation and said first and second interactive surfaces do not cooperate for self-supporting one of said first and second components on the second components when said first component is oriented in a second orientation opposite to said first orientation.

25. The apparatus of claim 19, wherein said first interactive surface and said second interactive surface cooperate so that said first component is self-supported on said second component.

26. The apparatus of claim 19, wherein:

said first component further includes a first air port, and said second component further includes a second air port, wherein, when said first and second interactive surfaces are in cooperation, said first air port communicates with said second air port.

27. The apparatus of claim 26, wherein:

said first interactive surface is asymmetrically shaped such that the first and second interactive surfaces cooperate only when said first liquid port is aligned with said second liquid port.

28. The apparatus of claim 19, wherein one of said first and second components is an adaptor configured to be positioned generally between a dispensing module and a manifold.

29. The apparatus of claim 19, wherein:

said recessed portion is defined between a first set of curvilinear surfaces, and said projecting portion is defined between a second set of curvilinear surfaces.

30. The apparatus of claim 19, wherein said recessed portion and said projecting portion are each generally bow-tie shaped.

31. The apparatus of claim 19, wherein said recessed portion and said projecting portion have shapes selected from the group consisting of:

(a) a rectangle, (b) a plurality of angled surface portions, (c) a generally rectangular shape with opposed curved portions, and (d) a dove-tail.

32. The apparatus of claim 19, wherein said recessed portion and said projecting portion include mating undercuts and associated lips for self-supporting one of said first and second components on the other of said first and second components.

33. The apparatus of claim 32, wherein said lips have opposed, chamfered surfaces.

34. A method for attaching a first component of a liquid thermoplastic material dispenser to a second component of the liquid thermoplastic material dispenser, the first component including a first face having a recessed portion extending only partially into the first component, the second component including a second face having a projecting portion complementary to the recessed portion and configured such that the recessed portion and the projecting portion cooperate, and the first and second faces further having respective first and second liquid ports therein, wherein the first liquid port is spaced from the recessed portion, the method comprising:

at least partially supporting one of the first and second components on the other of the first and second components by engaging the recessed portion of the first component with the projecting portion of the second component;

aligning the first and second liquid ports in fluid communication with each other; and fastening the first component to the second component using a separate fastener.

35. The method of claim 34, wherein at least partially supporting one of the first and second components on the other of the first and second components further comprises hanging one of the first component and second components on the other of the first and second components.

36. The method of claim 34, wherein at least partially supporting one of the first and second components on the other of the first and second components further comprises fully self-supporting one of the first component and second components on the other of the first and second components.

37. The method of claim 34, wherein the first face further includes a first air port and the second face further includes a second air port, and the method further comprises:

aligning the first and second air ports in fluid communication with each other.

38. The method of claim 34, wherein engaging the recessed portion of the first component with the projecting portion of the second component further comprises:

engaging a first curvilinear surface with a second curvilinear surface of complementary shape.

39. The method of claim 34, wherein the first and second components are two different components selected from the group consisting of: a dispensing module, a manifold, and an adaptor for coupling the dispensing module and the manifold.

* * * * *

UNITED STATES PATENT AND TRADEMARK OFFICE

CERTIFICATE OF CORRECTION

PATENT NO. : 7,296,706 B2
APPLICATION NO. : 10/976953
DATED : November 20, 2007
INVENTOR(S) : John M. Raterman et al.

It is certified that error appears in the above-identified patent and that said Letters Patent is hereby corrected as shown below:

Column 5
Line 40, “complimentary” should read -- complementary --.

Column 6
Line 32, “complimentary” should read -- complementary --.
Line 46, “and exemplary gun” should read -- an exemplary gun --.
Line 65, “306, projects” should read -- 306 projects --.

Column 8
Line 36, “complimentary” should read -- complementary --.
Line 38, “portion 1004” should read -- portions 1004 --.

Column 9
Lines 50-51, “adaptor 2606 is then” should read -- adaptor 2606 are then --.
Line 63, “complimentary” should read -- complementary --.

Column 10
Line 21, “complimentary” should read -- complementary --.

Column 11
Line 14, “lip 224, 226...” should read -- lips 224, 226 --.
Line 18, “complimentary” should read -- complementary --.
Line 19, “surface of the lips” should read -- surfaces of the lips --.
Lines 34-35, “complimentary” should read -- complementary --.
Lines 63-64, “the up and down direction” should read -- the up and down directions --.

Column 12
Line 28, “section b-f have” should read -- sections b-f have --.
Lines 47-48, “complimentary” should read -- complementary --.

Column 13
Line 34, “embodiments has” should read -- embodiments have --.
Line 35, “Applicant” should read -- Applicants --.

Column 15
Lines 40-41, Claim 24, “on the second components” should read -- on the other of said first and second components --.

UNITED STATES PATENT AND TRADEMARK OFFICE

CERTIFICATE OF CORRECTION

PATENT NO. : 7,296,706 B2
APPLICATION NO. : 10/976953
DATED : November 20, 2007
INVENTOR(S) : John M. Raterman et al.

It is certified that error appears in the above-identified patent and that said Letters Patent is hereby corrected as shown below:

Column 16

Lines 48-49, Claim 36, "one of the first component and second components" should read -- one of the first and second components --.

Signed and Sealed this

Fourteenth Day of October, 2008

JON W. DUDAS
*Director of the United States Patent and Trademark Office*

UNITED STATES PATENT AND TRADEMARK OFFICE

CERTIFICATE OF CORRECTION

PATENT NO. : 7,296,706 C1
APPLICATION NO. : 90/010873
DATED : July 26, 2011
INVENTOR(S) : John M. Raterman It is certified that error appears in the above-identified patent and that said Letters Patent is hereby corrected as shown below:

Column 1
Line 39, reads “may be chambered or” and should read -- may be chamfered or --.

Column 1
Line 48, reads “shaped complimentary” and should read -- shaped complementary --.

Column 3
Line 11, Claim 19, reads “formed as recessed” and should read -- formed as a recessed --.

Column 4
Lines 35-36, Claim 34, reads “wherein the first liquid port spaced from the recessed portion” and should read -- wherein the first liquid port is spaced from the recessed portion --.

Signed and Sealed this
Eighteenth Day of October, 2011

David J. Kappos

David J. Kappos
*Director of the United States Patent and Trademark Office*

US007296706C1

(12) EX PARTE REEXAMINATION CERTIFICATE (8429th)

United States Patent
Raterman et al.

(10) Number: US 7,296,706 C1
(45) Certificate Issued: Jul. 26, 2011

(54) METHOD AND SYSTEM FOR SUPPORTING AND/OR ALIGNING COMPONENTS OF A LIQUID DISPENSING SYSTEM

(75) Inventors: John M. Raterman, Atlanta, GA (US); Christopher R. Chastine, Hoschton, GA (US); Alain Chouinard, Laval, CA (US); Greg A. Craig, Dallas, GA (US); David Pullagura, Norcross, GA (US); Matthew R. Tinaglia, Suwanee, GA (US)

(73) Assignee: Nordson Corporation, Westlake, OH (US)

Reexamination Request:
No. 90/010,873, Mar. 23, 2010

Reexamination Certificate for:

| | |
|---|---|
| Patent No.: | **7,296,706** |
| Issued: | **Nov. 20, 2007** |
| Appl. No.: | **10/976,953** |
| Filed: | **Oct. 29, 2004** |

Certificate of Correction issued Oct. 14, 2008.

Related U.S. Application Data

(60) Provisional application No. 60/547,378, filed on Feb. 24, 2004.

(51) Int. Cl.
*B67B 7/00* (2006.01)
*G01F 11/00* (2006.01)

(52) U.S. Cl. ..... 222/1; 222/146.5; 222/570

(58) Field of Classification Search ..... None
See application file for complete search history.

(56) References Cited

U.S. PATENT DOCUMENTS

| | | | |
|---|---|---|---|
| 3,851,801 | A | 12/1974 | Roth |
| 4,579,309 | A | 4/1986 | Fujiwara et al. |
| 5,265,800 | A | 11/1993 | Ziecker et al. |
| 5,356,038 | A | 10/1994 | Banks |
| 5,683,037 | A | 11/1997 | Rochman et al. |
| 6,123,302 | A | 9/2000 | Taylor |
| 6,244,522 | B1 | 6/2001 | Reighard et al. |
| D515,177 | S | 2/2006 | Raterman et al. |
| 7,296,706 | B2 | 11/2007 | Raterman et al. |

*Primary Examiner*—Aaron J. Lewis

(57) ABSTRACT

In a liquid dispensing system having a dispensing module and a gun manifold, the gun manifold includes a shelf portion that extends outwardly from its front face and the dispensing module includes a correspondingly shaped aperture configured to engage the shelf portion so that the dispensing module rests, or hangs, on the gun manifold without being held into place. From this position, the module can be easily and readily attached to the manifold. The shelf and aperture have complementary shapes and can be keyed so as to require the mating of the manifold and module in only one orientation. Additionally, an adaptor can be provided between the module and manifold so that smooth face manifolds and modules can still be coupled to corresponding manifolds and modules having shelves or apertures.

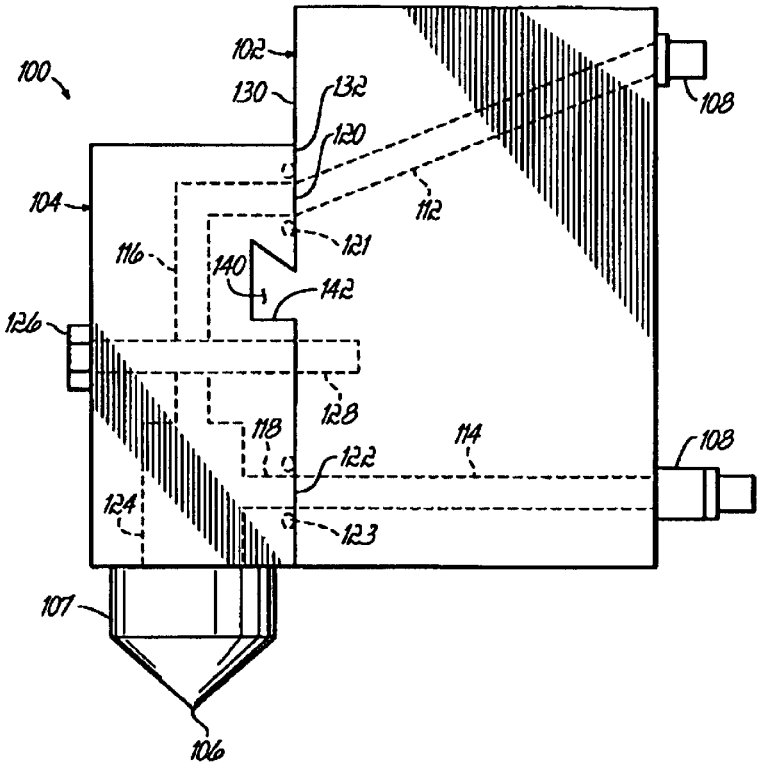

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 5, line 65 to column 6, line 20:

A recessed portion 212 is present between the air port 204 and the liquid port 206. In this exemplary embodiment, the recessed portion 212 resembles a "bow-tie" in that it has a narrow central region that flares outwardly on each side *as viewed along a direction normal to the rear face 201*. It will be appreciated that the embodiments shown in FIGS. 3A, 4, 7, 8, 10, 20, 23, 26 and 28 are further examples of bow-tie shapes. Recessed portion 212 includes a top curved portion 240 and a bottom curved portion 242. FIG. 2B provides a side view that highlights the shape of the recessed portion 212 and FIG. 2C provides a detailed view of the recessed portion 212. In particular, the top curved portion 240 includes an undercut region 220 that extends to form a lip 226 while the bottom curved portion 242 includes its own undercut portion 222 that extends to form a lip 224. The lip 226 permits the module 202 to be self-supporting in the vertical direction, as oriented in FIGS. 2A-2C, when it is placed on a gun manifold (not shown) having a complementary projecting portion. Thus, the module 202 will temporarily be retained by, or hang from, the manifold until bolts or other retainers can be inserted in the openings 208 and 210. Opposed surfaces of lips 224, 226 may be chambered or angled as shown in FIG. 2C to aid in mating the module 202 with another component.

Column 6, line 27 to column 6, line 45:

The top curved portion 240 and the bottom curved portion 242 may have the same or may have different radii of curvature. As illustrated in FIGS. 2A-2C, the curved portions 240, 242 have different radii of curvature. Accordingly, the complementary projecting portion of the manifold (not shown) will have appropriately shaped complimentary curved portions. As a result of this asymmetry, the module 202 will properly mate with the manifold in only one orientation. Thus, the recessed portion 212 of the module 202 can be considered "keyed" such that it operates to correctly orient the module 202 and, thereby, prevent an operator from inadvertently flipping the module 202 when attaching it to a manifold. The curved portions 240, 242 also act to properly align the module 202 with the gun manifold. Because of the curved shape, the module is urged towards proper side-to-side (*i.e., lateral*) alignment. Thus, the openings 204 and 206 will be aligned with their corresponding openings on the gun manifold. Similarly, the bolt holes 208, 210 will be properly aligned as well.

AS A RESULT OF REEXAMINATION, IT HAS BEEN DETERMINED THAT:

Claims 1, 8, 14, 19, 27, 30 and 34 are determined to be patentable as amended.

Claims 2-7, 9-13, 15-18, 20-26, 28, 29, 31-39, dependent on an amended claim, are determined to be patentable.

1. An apparatus for dispensing liquid thermoplastic material comprising:

a first component including a first side and at least one passageway for receiving the liquid thermoplastic material, said passageway including an opening on said first side and said first component further including a first interactive surface on said first side and configured as one of a recessed portion extending only partially into said first component and spaced from said opening or a projecting portion configured to extend only partially into a second component and spaced from said opening, said first interactive surface adapted to cooperate with a second interactive surface on the second component and thereby capable of either at least partially supporting said first component on the second component or at least partially supporting the second component on said first component, *whereby when said first interactive surface is engaged with the second interactive surface relative movement in vertical and lateral directions is limited.*

8. [The apparatus of claim 7, wherein:] *An apparatus for dispensing liquid thermoplastic material comprising:*

*a first component including a first side and at least one passageway for receiving the liquid thermoplastic material, said passageway including an opening on said first side and said first component further including a first interactive surface on said first side and configured as one of a recessed portion extending only partially into said first component and spaced from said opening or a projecting portion configured to extend only partially into a second component and spaced from said opening, said first interactive surface adapted to cooperate with a second interactive surface on the second component and thereby capable of either at least partially supporting said first component on the second component or at least partially supporting the second component on said first component;*

*wherein said first component further comprises a first air port; and said second component further comprises a second air port; wherein, when said first and second interactive surfaces are in cooperation, said first air port communicates with said second air port; and* wherein said first interactive surface includes asymmetrically curved surfaces such that the first and second interactive surfaces cooperate only when said first air port is aligned with said second air port.

14. [The apparatus of claim 1.] *An apparatus for dispensing liquid thermoplastic material comprising:*

*a first component including a first side and at least one passageway for receiving the liquid thermoplastic material, said passageway including an opening on said first side and said first component further including a first interactive surface on said first side and configured as one of a recessed portion extending only partially into said first component and spaced from said opening or a projecting portion configured to extend only partially into a second component and spaced from said opening, said first interactive surface adapted to cooperate with a second interactive surface on the second component and thereby capable of either at least partially supporting said first component on the second component or at least partially supporting the second component on said first component;* wherein said recessed portion and said projecting portion are each generally bow-tie shaped *such that said recessed portion and said projecting portion each defines a relatively narrow central portion and a pair of relatively wider portions disposed on opposite sides of said central portion as viewed along a direction normal to said first side*.

19. An apparatus for dispensing liquid thermoplastic material comprising:

a first component comprising a first face, said first face including a first interactive surface formed as recessed portion extending only partially into said first component, and a first liquid port spaced from said first interactive surface, and a second component comprising a second face, said second face including a second interactive surface complementary to said first interactive surface and a second liquid port, said second interactive surface formed as a projecting portion, wherein said recessed portion and said projecting portion cooperate to align said first and second liquids ports and to at least partially support one of said first and second components on the other of said first and second components, *whereby when said first interactive surface is engaged with the second interactive surface relative movement in vertical and lateral directions is limited*.

27. [The apparatus of claim 26,] *An apparatus for dispensing liquid thermoplastic material comprising:*

*a first component comprising a first face, said first face including a first interactive surface formed as a recessed portion extending only partially into said first component, and a first liquid port spaced from said first interactive surface, and a second component comprising a second face, said second face including a second interactive surface complementary to said first interactive surface and a second liquid port, said second interactive surface formed as a projecting portion, wherein said recessed portion and said projecting portion cooperate to align said first and second liquid ports and to at least partially support one of said first and second components on the other of said first and second components;*

*wherein said first component further includes a first air port, and said second component further includes a second air port, wherein, when said first and second interactive surfaces are in cooperation, said first air port communicates with said second air port; and* wherein[:] said first interactive surface is asymmetrically shaped such that the first and second interactive surfaces cooperate only when said first liquid port is aligned with said second liquid port.

30. [The apparatus of claim 19,] *An apparatus for dispensing liquid thermoplastic material comprising:*

*a first component comprising a first face, said first face including a first interactive surface formed as a recessed portion extending only partially into said first component, and a first liquid port spaced from said first interactive surface, and a second component comprising a second face, said second face including a second interactive surface complementary to said first interactive surface and a second liquid port, said second interactive surface formed as a projecting portion, wherein said recessed portion and said projecting portion cooperate to align said first and second liquid ports and to at least partially support one of said first and second components on the other of said first and second components;* wherein said recessed portion and said projecting portion are each generally bow-tie shaped *such that said recessed portion and said projecting portion each defines a relatively narrow central portion and a pair of relatively wider portions disposed on opposite sides of said central portion as viewed along a direction normal to said first side*.

34. A method for attaching a first component of a liquid thermoplastic material dispenser to a second component of the liquid thermoplastic material dispenser, the first component including a first face having a recessed portion extending only partially into the first component, the second component including a second face having a projecting portion complementary to the recessed portion and configured such that the recessed portion and the projecting portion cooperate, and the first and second faces further having respective first and second liquid ports therein, wherein the first liquid port spaced from the recessed portion, the method comprising:

at least partially supporting one of the first and second components on the other of the first and second components by engaging the recessed portion of the first component with the projecting portion of the second component *whereby relative movement in vertical and lateral directions is limited*; aligning the first and second liquid ports in fluid communication with each other; and fastening the first component to the second component using a separate fastener.

* * * * *